US012318015B2

(12) United States Patent
Smith, Jr. et al.

(10) Patent No.: US 12,318,015 B2
(45) **Date of Patent: *Jun. 3, 2025**

(54) LIGHTWEIGHT COLLAPSIBLE STOOL

(71) Applicant: Robert W. Smith, Jr., Lakewood, NY (US)

(72) Inventors: Robert W. Smith, Jr., Lakewood, NY (US); Merry Riehm-Constantino, Buffalo, NY (US); Alexander T. Reding, Lockport, NY (US)

(73) Assignee: Robert W. Smith, Jr., Lakewood, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/512,413

(22) Filed: Nov. 17, 2023

(65) Prior Publication Data

US 2024/0122353 A1 Apr. 18, 2024

Related U.S. Application Data

(63) Continuation of application No. 17/759,664, filed as application No. PCT/US2020/066408 on Dec. 21, 2020, now Pat. No. 11,871,851.

(60) Provisional application No. 62/954,832, filed on Dec. 30, 2019.

(51) Int. Cl.

| | |
|---|---|
| ***A47C 4/04*** | (2006.01) |
| ***A47C 1/023*** | (2006.01) |
| ***A47C 4/22*** | (2006.01) |
| ***A47C 4/52*** | (2006.01) |
| ***A47C 7/00*** | (2006.01) |
| ***A47C 7/02*** | (2006.01) |
| ***A47C 7/40*** | (2006.01) |
| *A47C 9/10* | (2006.01) |

(52) U.S. Cl.

CPC ..... *A47C 7/024* (2013.01); *A47C 1/023* (2013.01); *A47C 4/04* (2013.01); *A47C 4/045* (2013.01); *A47C 4/22* (2013.01); *A47C 4/52* (2013.01); *A47C 7/004* (2013.01); *A47C 7/006* (2013.01); *A47C 7/402* (2013.01); *A47C 9/105* (2013.01)

(58) Field of Classification Search

CPC ..... A47C 7/024; A47C 4/045; A47C 4/52

USPC ..... 297/17, 42

See application file for complete search history.

(56) References Cited

U.S. PATENT DOCUMENTS

| | | | | | |
|---|---|---|---|---|---|
| 1,325,164 | A | * | 12/1919 | Mowrey | A47B 3/04 248/435 |
| 2,709,560 | A | * | 5/1955 | Resk | F16M 11/08 396/428 |
| 2,819,776 | A | * | 1/1958 | Balsam | A45F 4/04 135/904 |
| 4,190,918 | A | * | 3/1980 | Harvell | A47C 4/52 D6/601 |
| 4,574,990 | A | * | 3/1986 | Remis | A45C 3/00 224/155 |
| 5,016,792 | A | * | 5/1991 | Jay | A45F 4/02 224/155 |
| 5,209,381 | A | * | 5/1993 | Jay | A47C 4/52 224/155 |
| 5,289,958 | A | * | 3/1994 | Jay | A45F 4/02 224/155 |

(Continued)

*Primary Examiner* — Rodney B White

(74) *Attorney, Agent, or Firm* — Simpson & Simpson, PLLC

(57) ABSTRACT

A lightweight, collapsible, and portable wheeled seat, e.g., a wheeled office chair or stool, for travel, storage, and mobility, is disclosed.

20 Claims, 18 Drawing Sheets

(56) References Cited

U.S. PATENT DOCUMENTS

| | | | | |
|---|---|---|---|---|
| 5,505,524 | A * | 4/1996 | Drumwright | A47C 7/004 297/17 X |
| 5,597,203 | A * | 1/1997 | Hubbard | A47C 7/024 297/301.1 |
| 6,264,078 | B1 * | 7/2001 | Bilang | A47C 4/52 297/54 |
| 6,839,928 | B1 * | 1/2005 | Woodall | A47C 5/125 5/656 |
| 7,350,863 | B2 * | 4/2008 | Engels | A47C 7/40 297/284.3 |
| 7,628,455 | B2 * | 12/2009 | Brodeur | A47C 15/004 297/312 |
| 9,648,958 | B2 * | 5/2017 | Pectol | A47C 9/10 |
| 10,973,725 | B2 * | 4/2021 | Mason | A47C 7/024 |
| 11,234,523 | B2 * | 2/2022 | Sun | A47C 4/22 |
| 11,547,201 | B1 * | 1/2023 | Sun | A47C 3/026 |
| 11,871,851 | B2 * | 1/2024 | Smith, Jr. | A47C 4/045 |
| 2014/0306493 | A1 * | 10/2014 | Obolewicz | A47C 4/42 297/16.2 |
| 2015/0182027 | A1 * | 7/2015 | Chang | A47C 7/024 297/344.1 |
| 2019/0082848 | A1 * | 3/2019 | McClintock | A47C 7/024 |
| 2020/0329873 | A1 * | 10/2020 | Sun | A47C 3/40 |
| 2021/0145178 | A1 * | 5/2021 | Riley | A47C 1/03222 |

* cited by examiner

LIGHTWEIGHT COLLAPSIBLE STOOL

CROSS REFERENCE TO RELATED APPLICATIONS

This application is a continuation of U.S. patent application Ser. No. 17/759,664, filed Jul. 28, 2022, now U.S. Pat. No. 11,871,851, which application is the national stage of Int. Pat. App. No. PCT/US2020/066408, filed Dec. 21, 2020, which application claims the benefit under Articles 4 and 8 of the Stockholm Act of the Paris Convention for the Protection of Industrial Property of U.S. Provisional Patent Application No. 62/954,832, filed on Dec. 30, 2019. Each of the above-identified applications are incorporated by reference in their entireties.

FIELD OF THE INVENTION

The invention relates generally to a lightweight, collapsible, and portable wheeled seat, e.g., a wheeled office chair or stool, for travel, storage, and mobility.

BACKGROUND

Manipulation of body parts performed by physical therapists, occupational therapists, medical nurses, chiropractors, and other office professionals and staff often requires that various movements to be achieved in order to perform the many manipulations for therapy. The professional will mostly perform the movements from a standing position. However, as can be expected, after providing therapy to a number of patients after considerable time, standing can become laborious and tiring to the professional. It, thus, often becomes necessary to perform said duties from a seated position, which is usually accomplished from various types of wheeled office chairs or stools.

The typical wheeled chair or stool is wheeled in order to allow the professional to quickly re-position themselves according to procedures needed to be performed. The underlying need to readily and quickly reposition themselves from a seated position is usually achieved via the typical wheeled stool or chair, which is usually not problematic in the context of an office or clinical setting. However, in the case where a therapist, for example, may need to provide therapy at a location other than their office or clinical setting and at a location where space may be limited, typical wheeled chairs and stools can be heavy, cumbersome, difficult to transport, or awkward. For example, the typical fixed wheeled chair or stool is normally awkward and/or not an efficient design in terms of space due to the fixed wheeled components that commonly include three, five, or six, leg portions that extend from a central stem or hub. Additionally, their general size and configuration is not particularly well-suited for use in tight spaces, for example, between therapy tables, tight clinical settings, or on-location settings. Their fixed nature, lack of adjustability, and weight is also not ideal for easy transport or storage.

Additionally, while collapsible stools and chairs are available, which for example, may include telescoping components for raising and lowering seat height and/or collapsible legs for storage or transport, such chairs or stools often sacrifice ergonomics, comfort, and/or strength and stability for ease of collapsibility. For example, such chairs and stools often have small, uncomfortable seats that lack lumbar support, are designed to favor collapsibility in favor of stability, and/or are fabricated from components that are insufficiently robust. Thus, a lightweight, collapsible chair or stool or chair that addresses the above issues is needed.

A lightweight, collapsible chair or stool in accordance with the instant disclosure attempts to address the aforementioned issues by providing, among other things, a robust collapsible and portable wheeled chair or stool that includes a large, sturdy, foldable and comfortable seating surface, an extendable and collapsible lumbar support, and collapsible legs including wheels—all of which are designed and assembled for comfort, stability, weight reduction, and transport and storage considerations.

SUMMARY

At the outset it should be understood that while the following disclosure, figures, and/or claims, etc. describe subject matter including one or more aspects described as either alone or in combination with one or more other aspects, the subject matter of the instant disclosure is not intended to be so limited. That is, the instant disclosure, figures, and claims are intended to encompass the various aspects described herein, either alone or in one or more combinations with one another. For example, while the instant disclosure may describe and illustrate a first aspect, a second aspect, and a third aspect in a manner such that the first aspect is only specifically described and illustrated relative to the second aspect, or the second aspect is only described and illustrated relative to the third aspect, the instant disclosure and illustrations are not intended to be so limiting and may encompass the first aspect alone, the second aspect alone, the third aspect alone, or one or more combinations of the first, second, and/or third aspects, e.g., the first aspect and the second aspect, the first aspect and the third aspect, the second and third aspect, or the first, second and third aspects.

According to aspects described and illustrated herein, there is generally provided a lightweight, collapsible chair or stool, including a collapsible lumbar support, a collapsible base and a plurality of wheels.

In some aspects, a collapsible seat, e.g., a chair or stool, includes a seat base member and a seat surface member collapsible between an open, extended position, which is configured to provide a seating surface, and a collapsed, closed position. In some aspects, the seat surface member includes a central seating surface member fixed to the seat base member that has an outer perimeter, and a pair of oppositely disposed and generally u-shaped seating surface members pivotally secured to the seat base member. In some aspects, each of the generally u-shaped seating surface members include a pair of leg portions that extend from a base portion thereof. In some aspects, each of the u-shaped seating surface members have an inward directed perimeter and a portion of each inward directed perimeter has a shape that substantially complementarily corresponds to a shape of a portion of the outer perimeter of the central seating surface member. In some aspects, each of the leg portions include a hinge assembly secured proximate terminal ends thereof and to the seat base member such that each oppositely disposed and generally u-shaped seating surface member is pivotal between the open, extended position, and the collapsed, closed position. In some aspects, when pivoted to the open, extended position, the inward directed perimeter of each of the pair of generally u-shaped seating surface members describe a recess that substantially complementarily bounds and receives the outer perimeter of the central seating surface member therein.

In some further aspects, the outer perimeter of the central seating surface member substantially describes at least one or more of a portion of: a line, an arc, a circle, an oval, and a square, and the inward directed perimeter of each of the pair of generally u-shaped seating surface members has a shape that is substantially complementary therewith. In other words, the central seating surface member can be for example, a circle, an oval, square, or other shape, and the generally u-shaped seating surface members, when placed in the open extended position, have a complementary shape that bound the central seating surface member.

In some aspects, the seat base member is configured to fixedly secure the central seating surface member and pivotally secure each of the pair of generally u-shaped seating surface members on an upper side thereof and the upper surface of the seat base member has a perimeter that is larger than the perimeter of the central seating surface member. In some aspects, the central seating surface member is fixedly secured proximate a center of the upper side of the seat base member, and the pair of generally u-shaped seating members are pivotally secured to the upper surface of the seat base member at positions not corresponding to the central seating surface member.

In some aspects, a pivoting range of movement of the generally u-shaped seating surface members is between 0°, which corresponds to the open, extended position, and 90°, which corresponds to the closed, collapsed position. In some aspects, the upper side of the seat base member serves as a stop to limit the range of movement of the generally u-shaped seating surface members.

In some aspects, the seat base member is formed of one or more lightweight materials, e.g., aluminum or plastic, and includes a plurality of intersecting structural support ribs substantially forming a coffered structure, which tends to provide weight reduction, as well as strength and stability to the seat base member.

In some aspects, the seat base member includes a centrally disposed socket configured to connect the seat base member to a central support member including a telescoping piston member configured to adjust a height of the seating surface member. In some aspects, the central support member communicates with an adjusting lever allowing the height of the seating surface member to be adjusted.

In some aspects, the central support member includes a cylindrical collar having a cylindrical cavity configured to receive and secure the piston member therein. In some aspects, the cylindrical collar comprises at least two mating members detachable securable to one another. In some aspects, each of the mating members including at least one tapered structural support rib on an inner surface thereof such that when the at least two mating members are secured to one another for purposes of receiving and securing the piston member therein, a bias may be applied by the tapered ribs to the piston member to thereby frictionally secure the piston member within the cavity. In some aspects, each of the mating members include at least one recess that extends about an outer wall thereof such that when the at least two mating members are secured to one another to form the cylindrical collar, the recesses align with one another to extend about the circumference of the cylindrical collar. In some aspects, when a first leg retaining bracket is disposed within the aligned recesses, the first leg retaining bracket is secured therein and prevented from longitudinally directed movement relative to the cylindrical collar. In some aspects, a second leg retaining bracket is securable about a circumference of the piston member, the second leg retaining member being configured for longitudinally directed sliding movement relative to the piston member. In some aspects, the first and second leg retaining members pivotally secure at least three leg members such that the leg members are pivotal between an open, extended position, and a closed, collapsed position. In some aspects, an upper portion of the cylindrical collar serves as a stop to limit a range of the longitudinal movement of the second leg retaining member such that the leg members may be retained in the open, extended position. In some aspects, each of the legs include a wheel/caster member In some aspects, the collapsible seat includes a multi-positionable lumbar support assembly that is positionable between an open, extended position and a closed, collapsed position. In some aspects, the multi-positionable lumbar support is formed from one or more tube members that comprise a first end portion rotatably secured to a bottom surface of one of the generally u-shaped seating surface members, and a second end portion that rotatably secures a backrest member. In some aspects, the first end portion rotatably secured to the bottom surface of one of the generally u-shaped seating surface members includes at least one detent mechanism configured to maintain the multi-positionable lumbar support assembly in the open, extended position and the closed, collapsed position. In some aspects, the detent mechanism includes a biased ball/pin member and a plurality of linearly incremented through-holes for receiving the ball/pin member therein to incrementally linearly position the rotationally positionable lumbar support assembly in a frontward/rearward direction. In some aspects, the detent mechanism includes a biased ball/pin member and a rotationally offset through-hole or channel for purposes of locking or placing the multi-positionable lumbar support assembly member in the closed/collapsed position. In some aspects, the multi-positionable lumbar support assembly includes a mid-portion between the first end portion and the second end portion, the mid-portion being rotatable and telescopeable to thereby allow the backrest member to be rotated and also allow a height of the backrest member to be incrementally adjusted. In some aspects, the mid-portion includes a detent mechanism, e.g., a biased ball/pin member and a plurality of linearly incremented through-holes for receiving the ball/pin member therein such that the backrest member can be rotationally adjusted and incrementally linearly positioned in an upward/extended direction, and one or more rotationally offset through-holes such that the backrest member may be positioned in a downward/collapsed direction. In some aspects, backrest member position may be maintained by frictional forces between a tube member and a bracket. While not shown, it should be understood that the backrest member may be positioned, and the position maintained, by means of a detent mechanism that limits a range of rotation of the backrest member, the detent mechanism including a ball/pin member receivable in one or more through-holes or a slot/channel in the bracket. Additionally, a compression-type locking mechanism or a clutch-type locking mechanism, for example, could also be used to adjust/arrest movement of the lumbar support assembly.

In some aspects, each of the pair of generally u-shaped seating surface members include a carrying handle member on an outer edge thereof such that when each generally u-shaped seating surface members is pivoted to the open, extended position, the carrying handle members are oriented such that they correspond to leftward/rightward sides of the collapsible seat, and when each generally u-shaped seating surface members is pivoted to the closed, collapsed position, the carrying handle members are oriented toward an upper side of the collapsible seat for readily carrying the collapsed seat. In some aspects, each of the carrying handle members are slidably secured to outer edge of a respective seating surface member and each further comprise an magnet/magnetically attractive member that is magnetically attracted to a magnetically attractive member/magnet disposed proximate the surface of the outer edge of each of the u-shaped seating surface members. In some aspects, the seating surface member is upholstered/cushioned with a cover suitable for a clinical setting, e.g., non-absorbing, that is capable of withstanding significant wear and tear, e.g., leather or faux-leather, and a cellular foam, e.g., a closed cell foam, an open cell foam, memory foam, self-skinning foam, or one or more combinations thereof.

These and other aspects, features, and advantages of the present disclosure will become readily apparent upon a review of the following detailed description of the disclosure, in view of the drawings and appended claims.

BRIEF DESCRIPTION OF THE DRAWINGS

Various aspects are disclosed, by way of example only, with reference to the accompanying schematic drawings in which corresponding reference symbols indicate corresponding parts, in which.

DETAILED DESCRIPTION

Figure 1A:
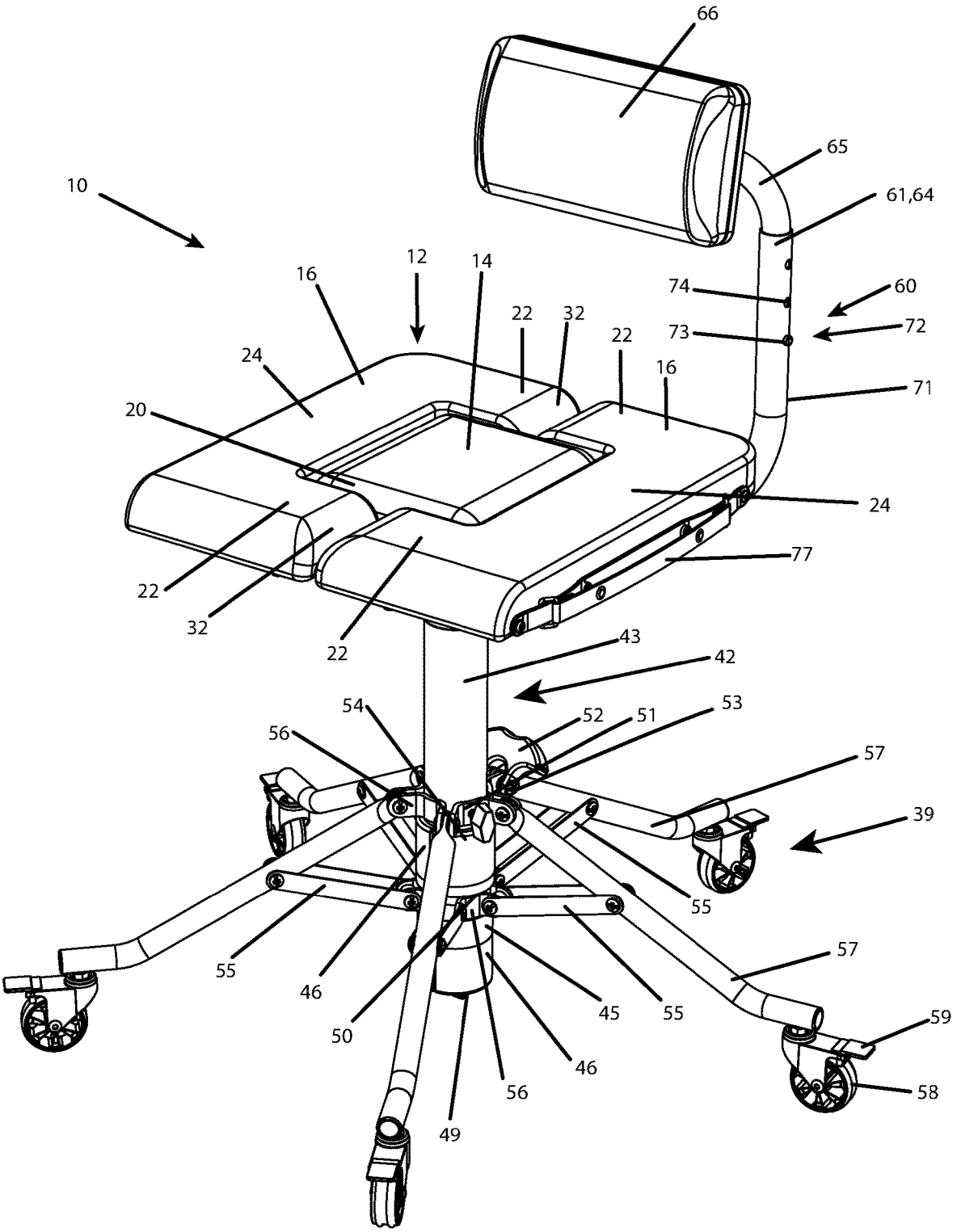
FIG. 1A is a perspective view of a collapsible seat in an open/extended position.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice the example aspects.

It should be appreciated that the terms "substantially" and "generally" are synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when stating that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

As previously set forth, while the following disclosure and accompanying figures, and/or claims, etc. describe subject matter including one or more aspects described as either alone or in combination with one or more other aspects, the subject matter of the instant disclosure is not intended to be so limited. That is, the instant disclosure, figures, and claims are intended to encompass the various aspects described herein, either alone or in one or more combinations with one another. For example, while the instant disclosure may describe and illustrate a first aspect, a second aspect, and a third aspect in a manner such that the first aspect is only specifically described and illustrated relative to the second aspect, or the second aspect is only described and illustrated relative to the third aspect, the instant disclosure and illustrations are not intended to be so limiting and may encompass the first aspect alone, the second aspect alone, the third aspect alone, or one or more combinations of the first, second, and/or third aspects, e.g., the first aspect and the second aspect, the first aspect and the third aspect, the second and third aspect, or the first, second and third aspects.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

Figure 1B:
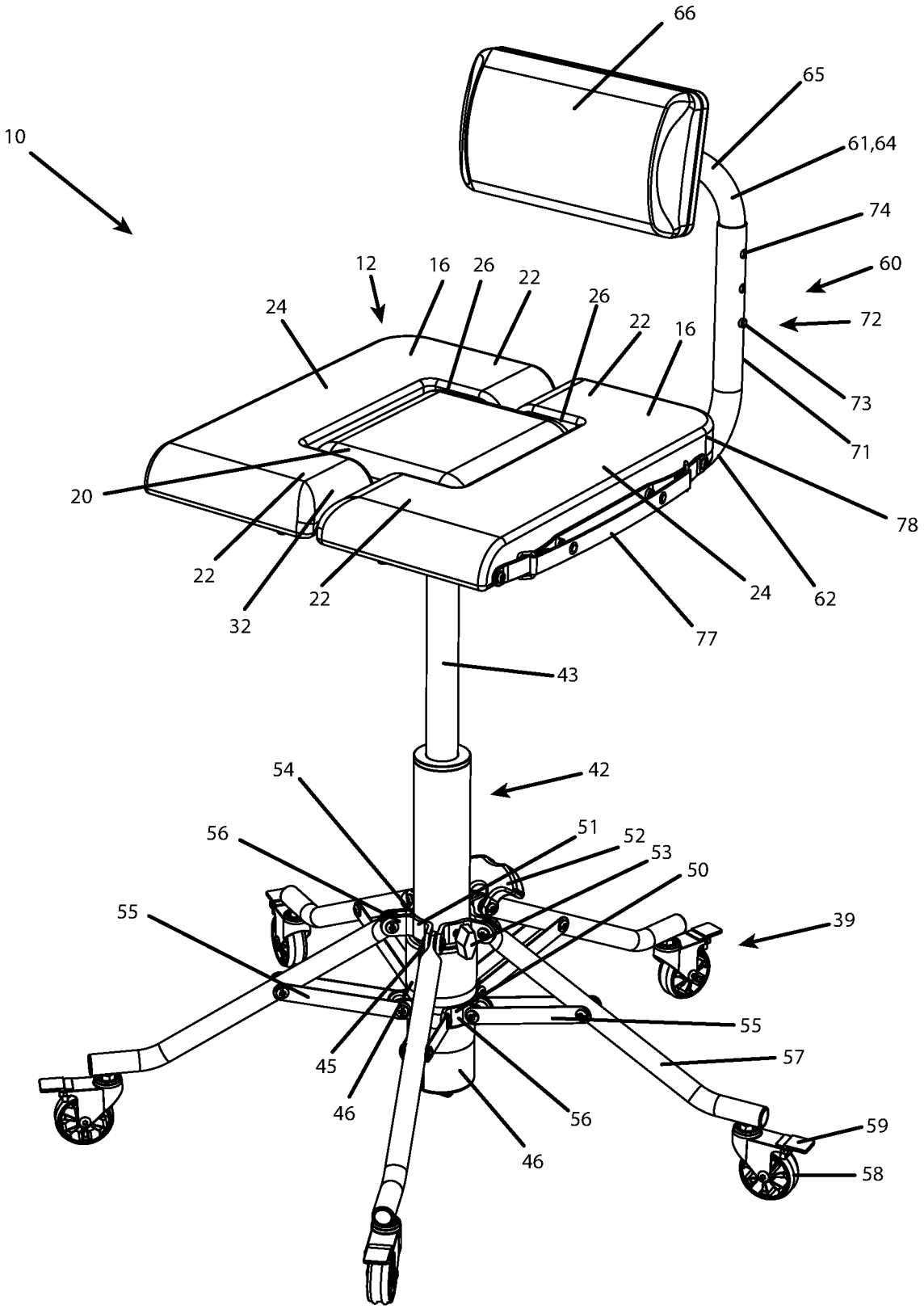
FIG. 1B is a perspective view of a collapsible seat in an open/extended position further showing the seating surface member and backrest member in raised positions.
Figure 1C:
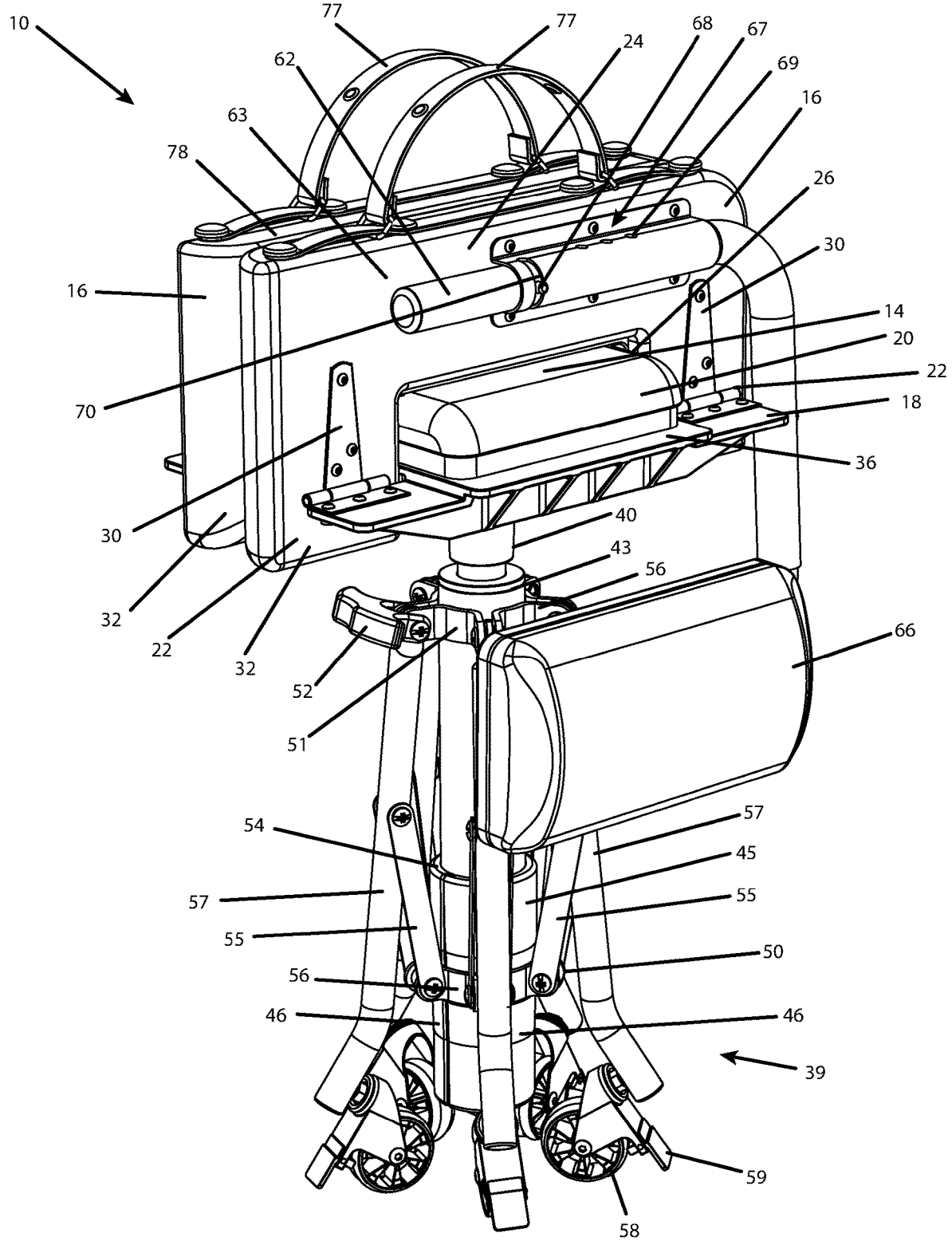
FIG. 1C is a perspective view of a collapsible seat in a closed/collapsed position.
Figure 2:
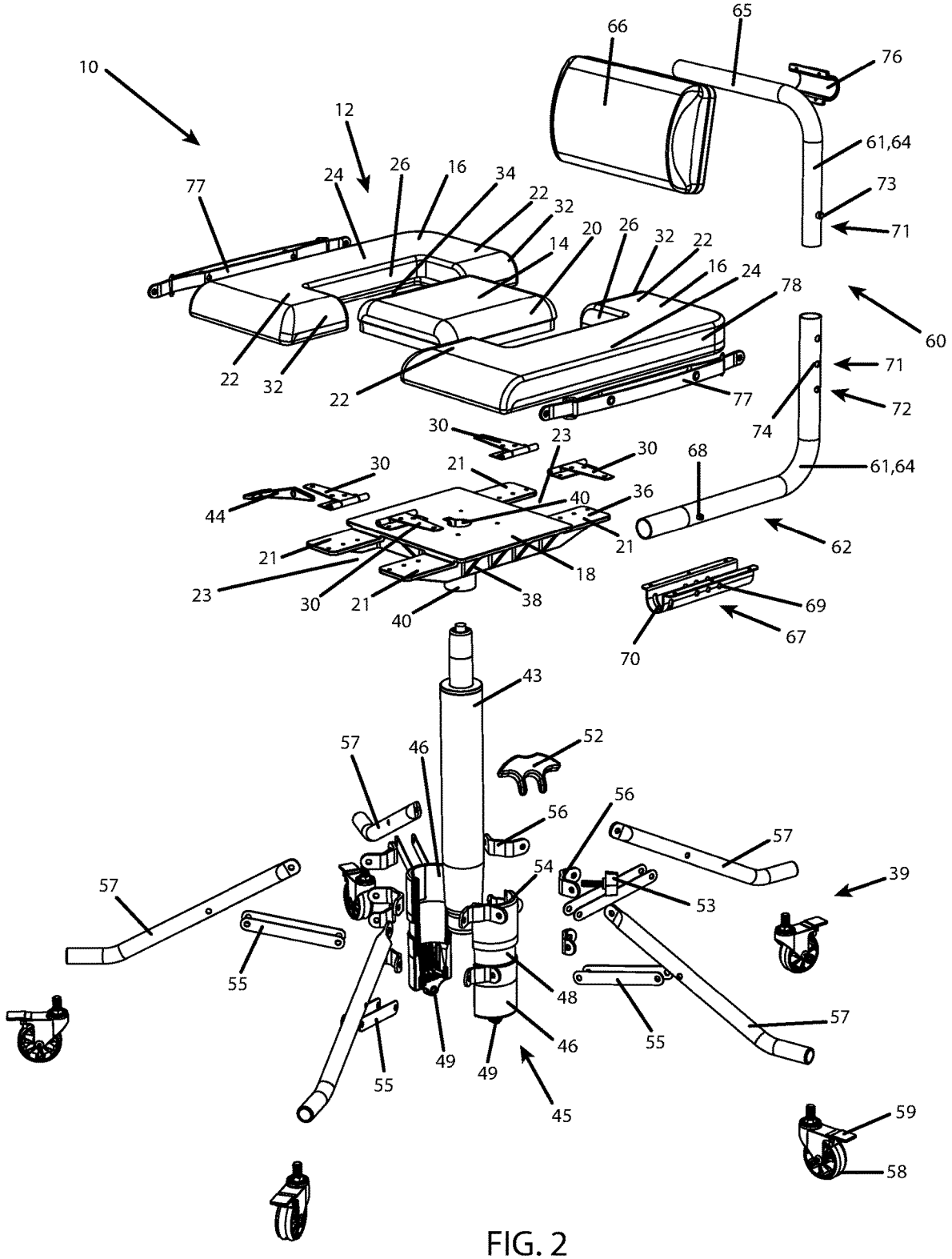
FIG. 2 is an exploded perspective view of a collapsible seat.

Adverting now to the figures, as shown in FIGS. 1-2, collapsible seat 10 generally comprises seating surface assembly 12, leg/wheel assembly 39, central support assembly 40, and multi-positional lumbar support assembly 60.

Seat surface assembly 12 generally includes central seating surface member 14 and a pair of generally U-shaped seating surface members 16, each of which are secured to generally H-shaped seat base member 18. Central seating surface member 14 and pair of generally U-shaped seating surface members 16 (as well as backrest 66) can be upholstered/cushioned with a cover suitable for a clinical setting, e.g., non-absorbing, that is capable of withstanding significant wear and tear, e.g., leather or faux-leather, and can also include cushioning material a such as cellular foam, e.g., a closed cell foam, an open cell foam, memory foam, self-skinning foam, or one or more combinations thereof. Central seating surface member 14 describes an outer perimeter 20. Generally U-shaped seating surface members 16 each include leg portions 22 and base portions 24 which define a perimeter including inwardly directed perimeter 26. Each of the generally U-shaped seating surface members 16 include a pair of leg portions 22 including terminal ends 32 that substantially abut terminal ends of another oppositely disposed generally U-shaped seating surface member when the collapsible seat is placed in the open extended position. As may be appreciated from the figures, inwardly directed perimeter 26 forms a recess/void 34 that complementarily receives the outer perimeter 20 of the central seating surface member 14 therein. Accordingly, when the generally U-shaped seating surface members 16 are placed in the open/extended position, the generally U-shaped seating surface members 16 substantially abut and bound the central seating surface member 14. As may be further appreciated, various perimeter edges of the central seating surface member 14 and generally U-shaped seating surface members 16 can be chamfered, as appropriate, for purposes of providing comfort to a user, as well as to allow the generally U-shaped seat surface members 16 to be more easily collapsed relative to the central seating surface member 14 and received within void/recess 23 of H-shaped seat base member.

While the central seating surface member 14 is shown as being in the shape of a square, and the central seating surface member 14 in combination with the generally U-shaped seating surface members 16 are shown as forming a square shape when placed in the open/extended position (See, e.g., FIG. 1), it should be understood that the central seating surface member 14 can be other shapes, i.e., other polygons, round, oval, etc., or combinations thereof, (and the generally U-shaped members having shapes complementary thereto), and the central seating surface member 14 in combination with the generally U-shaped seating surface members 16 can form other shapes as well when placed in the open extended position, i.e., other polygons, round, oval, etc., or combinations thereof.

Figure 3A:
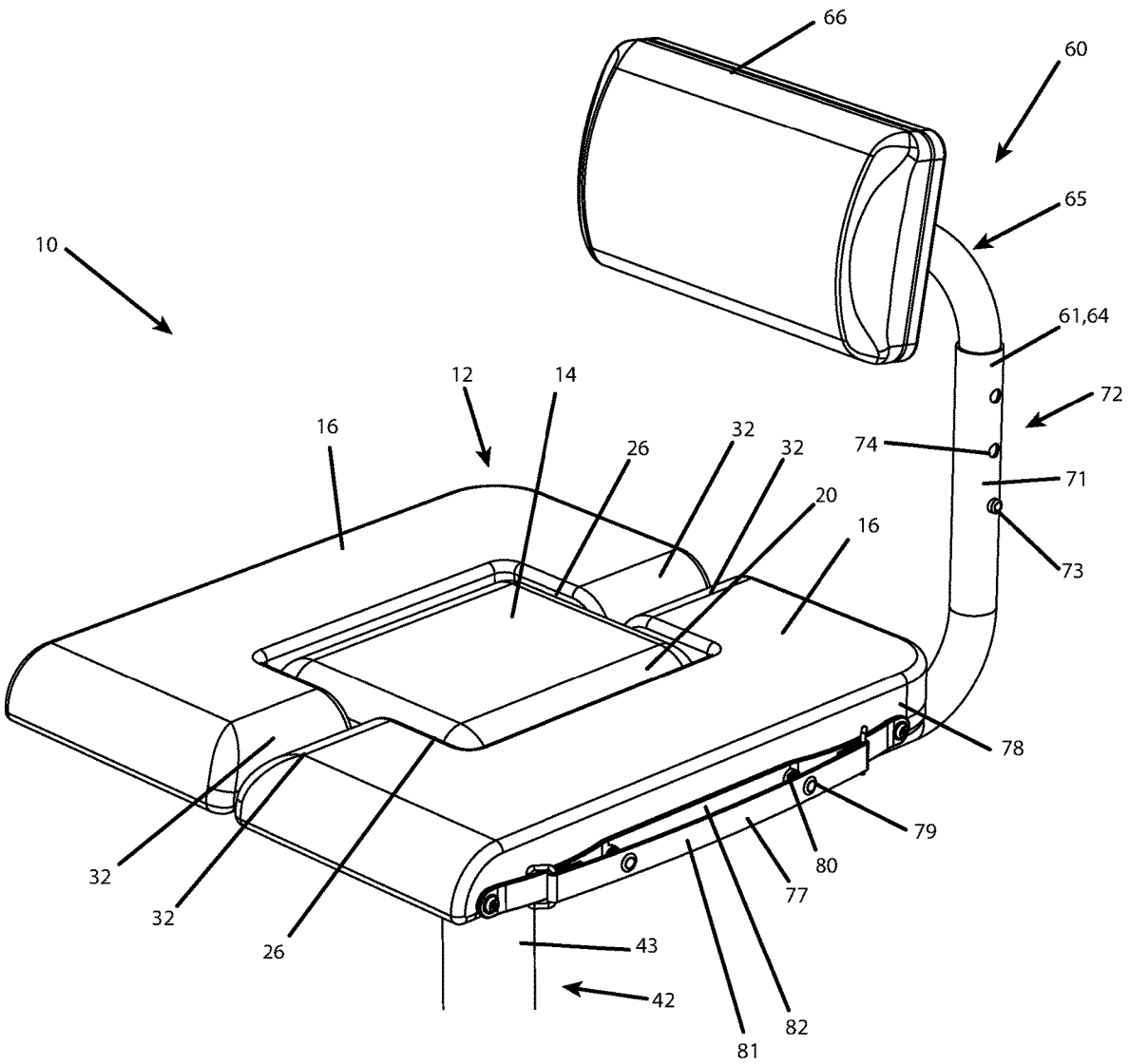
FIG. 3A is a close-up perspective view of a seating surface member and backrest member of a collapsible seat in an open/extended position.
Figure 3B:
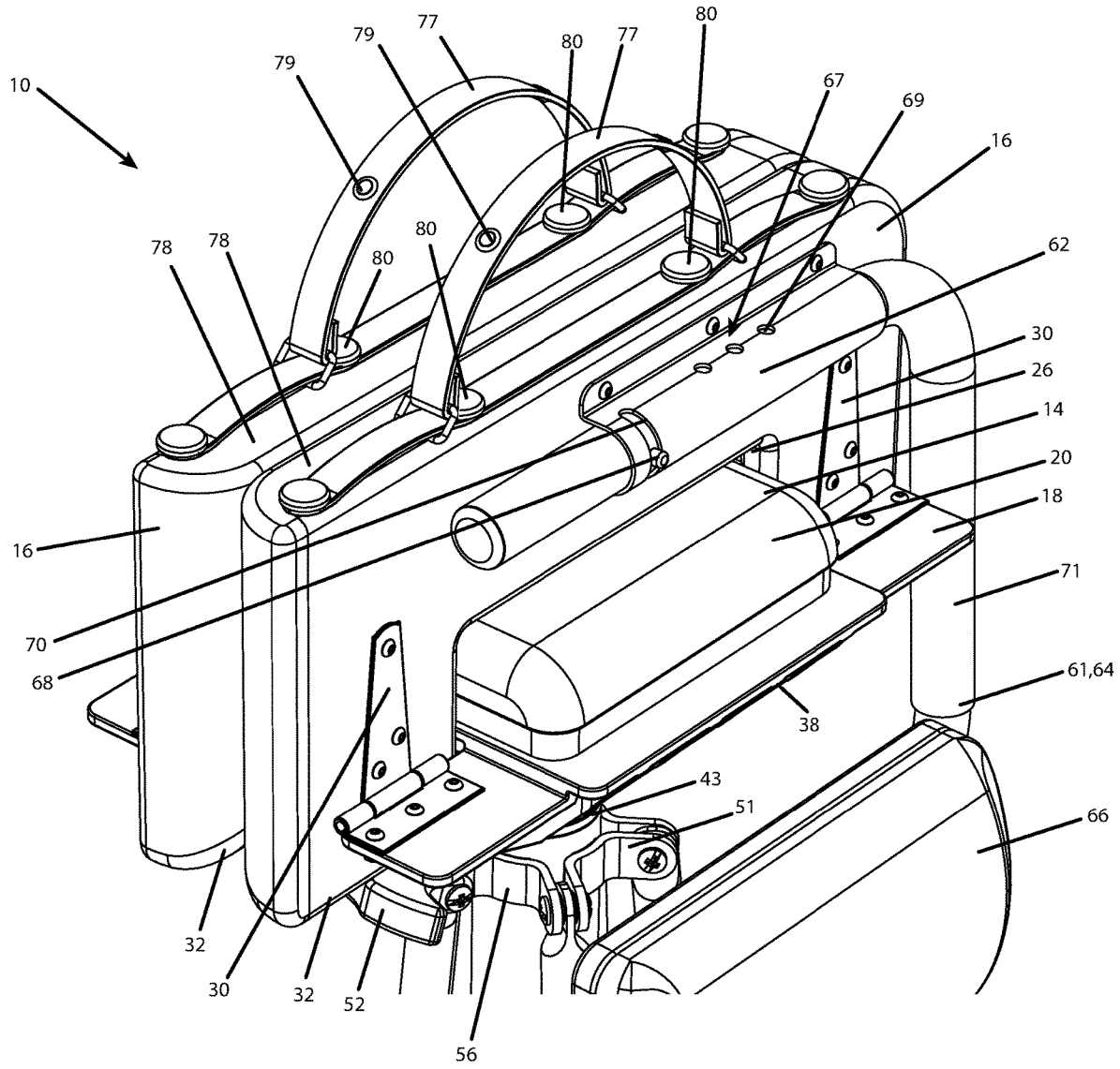
FIG. 3B is a close-up perspective view of a seating surface member of a collapsible seat in a closed/collapsed position.
Figure 4:
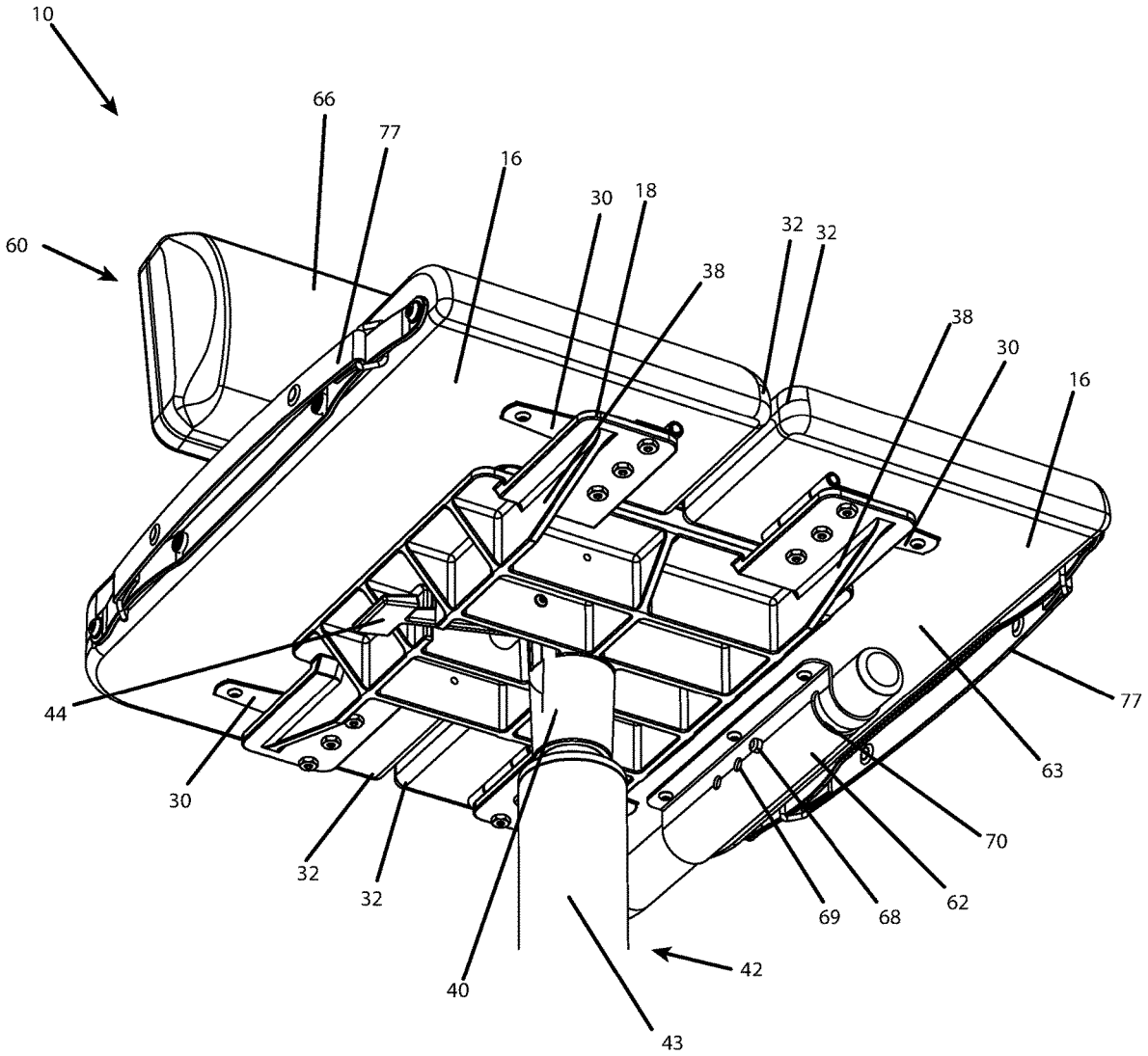
FIG. 4 is a close-up perspective view of a seating surface member of a collapsible seat in a closed/collapsed position from a view-point taken from below the seating surface member.

In addition to the above, generally U-shaped seating surface members 16 include outer edges 78 that can include carrying handles 77 capable of being laid flat when the collapsible seat is placed in the open/extended position (See, e.g., FIG. 1A), and also capable of being moved to a raised/extended position when the collapsible seat is placed in the closed/collapsed position (See, e.g., FIG. 1C). As shown in FIGS. 3A and 3B, in order to allow the carrying handles 77 to be laid flat and maintain such position, magnets/magnetically attractive members 79 can be secured in or on a first strap portion 81 of carrying handle 77, and mating magnetically attractive members/magnets 80 can be secured in or on a second strap portion 82 of carrying handle 77 for mating therewith. As shown in FIGS. 1C, 3B and 4, bottom surface 63 of one or the generally U-shaped seating surface members 16 is configured to secure multi-positional lumbar support assembly 60 thereto.

As shown in FIGS. 2 and 4, generally H-shaped seat base member 18 is provided for purposes of fixedly securing the central seating surface member 14, as well as hingedly securing generally U-shaped seating surface members 16 thereto. Seat base member 18 can be formed of a lightweight material such as plastic or one or more lightweight metals such as aluminum. As shown in FIG. 4, generally H-shaped seat base member 18 can comprise a plurality of structural support ribs 38 that intersect with one another to thereby form a coffered-type structure, which provides significant reductions in the weight of the seat base member 18 without sacrificing strength and/or stability.

As may also be appreciated from FIGS. 2 and 4, generally H-shaped seat base member 18 includes a central portion 19 and a plurality of leg portions 21 extending from the central portion 19 such that a recess 23 is formed between oppositely disposed leg portions 21. Recess 23 is provided for receiving terminal ends 32 of leg portions 22 of generally U-shaped seating surface members 16 therein when the generally U-shaped seating surface members 16 are placed in the closed/collapsed position of FIG. 1C, for example.

As also shown in FIG. 1C, central portion 19 has an upper surface 36 that is disposed at a position that is slightly higher than an upper surface of the leg portions 21. The height differential between the central portion 19 and the leg portions 21 provides a recess that allows leaf and pin portions of each of a plurality of hinge assemblies 30 to be received therein. As may be appreciated, for each hinge assembly, a first leaf thereof can be secured to the seat base member 18 and a second leaf thereof may be secured to respective leg portions 22 of U-shaped seating surface members 16. While not shown in the figures, each of the leg portions 21 of the seat base member 18 (or the bottom surface 63 of the leg portions 23 of each of the generally U-shaped seating surface members 16) can include one or more stops having a height substantially equivalent to the height differential between the central portion 19 and the leg portions 21, which allows the height of the surface of the central seating surface member 14 and the generally-U-shaped seating surface members 16 to be the approximately the same when the collapsible seat is placed in the open/extended position of FIG. 1A, for example. In some aspects, the stops can be formed from a resilient material, such as rubber.

As also shown in FIG. 1C, the central portion 19 of the H-shaped seat base member 18 has a perimeter that is larger than outer perimeter 20 of the central seating surface member 14 such that a portion of the upper surface 36 of the seat base member 18 extends beyond the central seating surface member 14. When placed in the open/extended position, the portion of the upper surface 36 extending beyond the central seating surface member receives bottom surface 63 of base portion 24 of generally U-shaped seating surface members 16 thereon and serves as a stop to prevent further pivoting movement of the generally U-shaped seating surface members.

As shown in FIG. 4, seat base member 18 includes centrally dispose socket 40 for receiving a first end of piston member 43 of the central support assembly 42 therein, and also includes height adjustment lever 44 for purposes of interaction with the piston member 43 for purposes of raising and lowering the seating surface assembly. Piston member 43 is generally of a type known in the art and is preferably lightweight for purposes of easing transport.

Figure 5A:
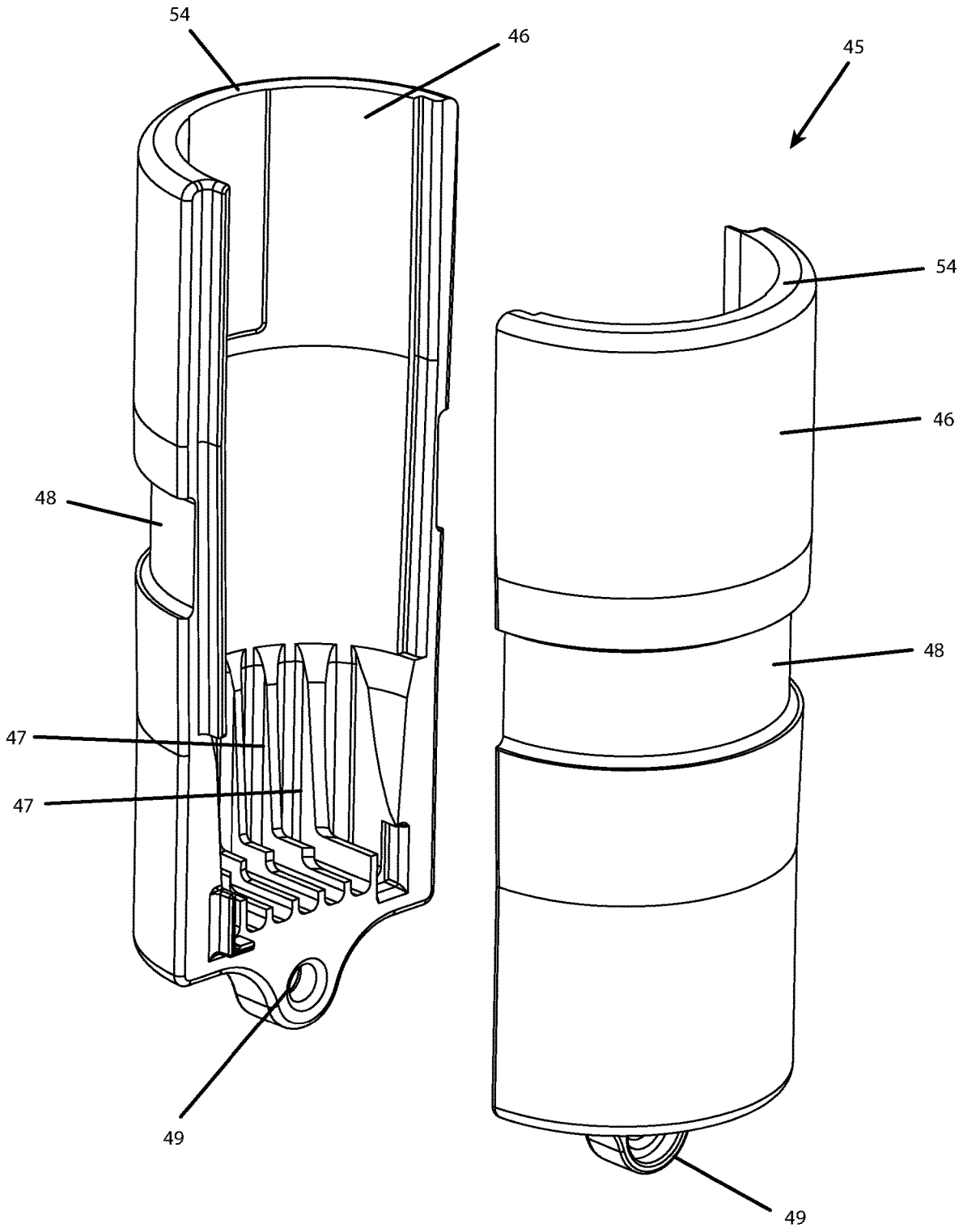
FIG. 5A is a close-up perspective view of mating members of a cylindrical collar of a collapsible seat.
Figure 5B:
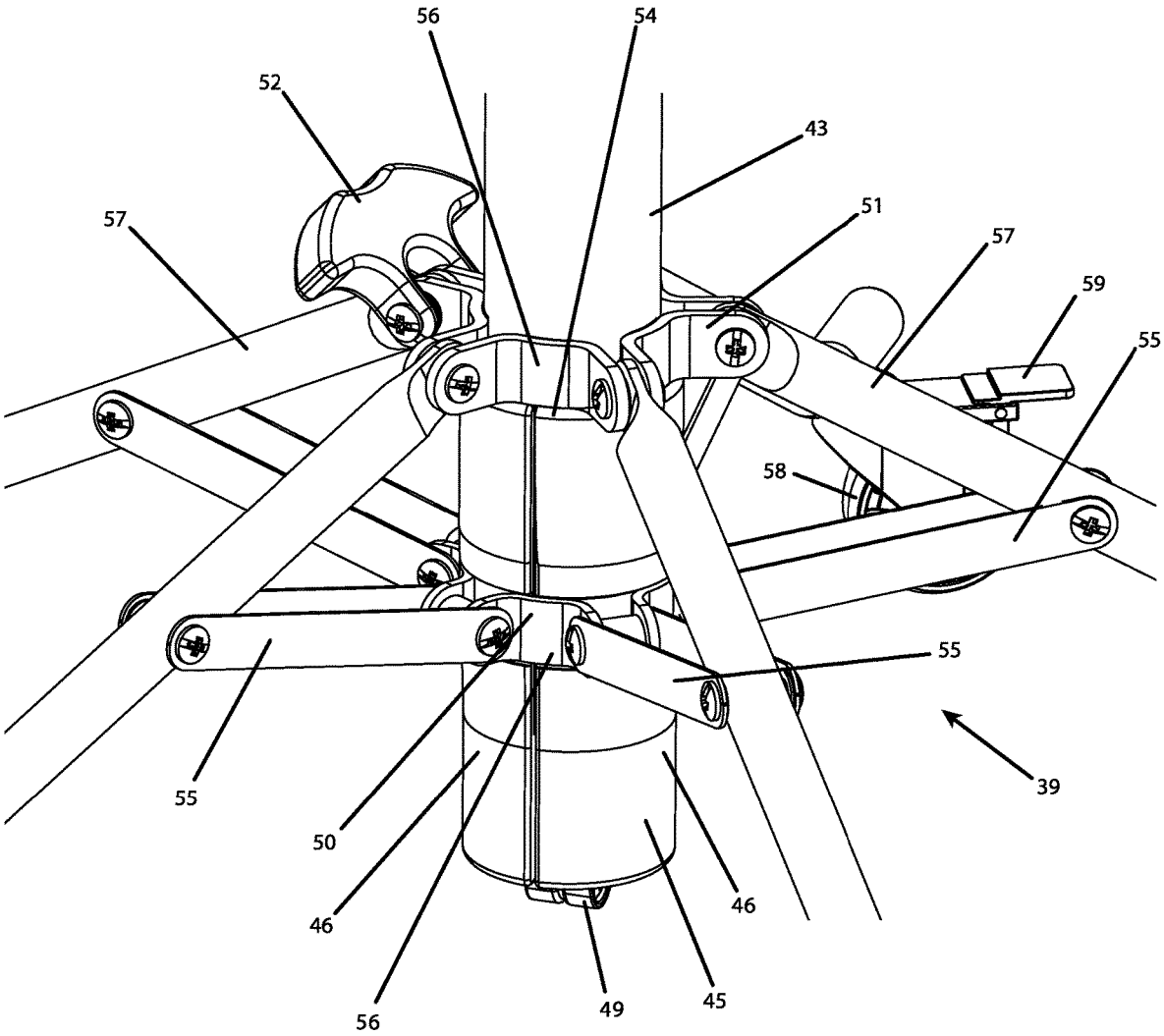
FIG. 5B is a close-up perspective view of mating members of a cylindrical collar of a collapsible seat mated to one another.

Central support assembly 42 generally includes piston member 43 and cylindrical collar 45 for receiving a second end of the piston member 43 therein. As shown in FIGS. 2, 5A and 5B, cylindrical collar 45 is formed from a pair of cylindrical collar mating members 46, detachably securable to one another by means of collar member fastening assembly 49 and first lower retaining bracket assembly 50.

As may be appreciated from FIG. 5A, each of the cylindrical collar mating members 46 includes tapered structural support ribs 47 at a lower end thereof, a collar mating recess 48 proximate a mid-portion of each member, and an upper end portion 54, which serves as a stop to prevent further movement of the second/upper retaining bracket assembly 51 when placed in the open/extended position. As shown in FIGS. 5A and 5B, the cylindrical collar mating members 46 are provided to detachably matingly secure to one another so as to form a generally cylindrical cavity capable of receiving the second end of the piston member 43 therein.

In accordance therewith, collar member fastening assemblies 49 are generally shown as including a pair of projections each including a through-hole capable of receiving a corresponding nut or bolt, for example, for securing the cylindrical collar mating members 46 to one another at a lower end. The cylindrical collar mating members 46 may be secured to one another at a mid-portion via collar mating recesses 48 disposed proximate the mid-portion of each of the members. As may be appreciated, recesses 48 are disposed at a same position along the cylindrical collar mating members 46 such that when the mating members 46 are secured to one another, the recesses they align so as to form a continuous recess about the cylindrical collar 45.

As shown in FIG. 5B, recesses 48 are configured to receive U-shaped bracket members 56 of first lower retaining bracket assembly 50 therein such that the U-shaped bracket members 56 may be secured to one another about the recesses 46 to secure the mating members 46 to one another.

As may be appreciated, by providing detachably securable mating members 46 including tapered structural support ribs 47, that are securable to one another via collar member fastening assembly 49, and recesses 48 and U-shaped bracket members 56 securable to one another via, for example, appropriate length bolts, nuts, and spacers (See FIG. 5B), it is possible to readily modify the size of the cylindrical collar cavity so as to be capable of accepting and frictionally securing gas pistons 43 of varying sizes, e.g., gas pistons having differing diameters and circumferences, which can be important in the context of logistics and the availability of different gas pistons from various sources.

Figure 5C:
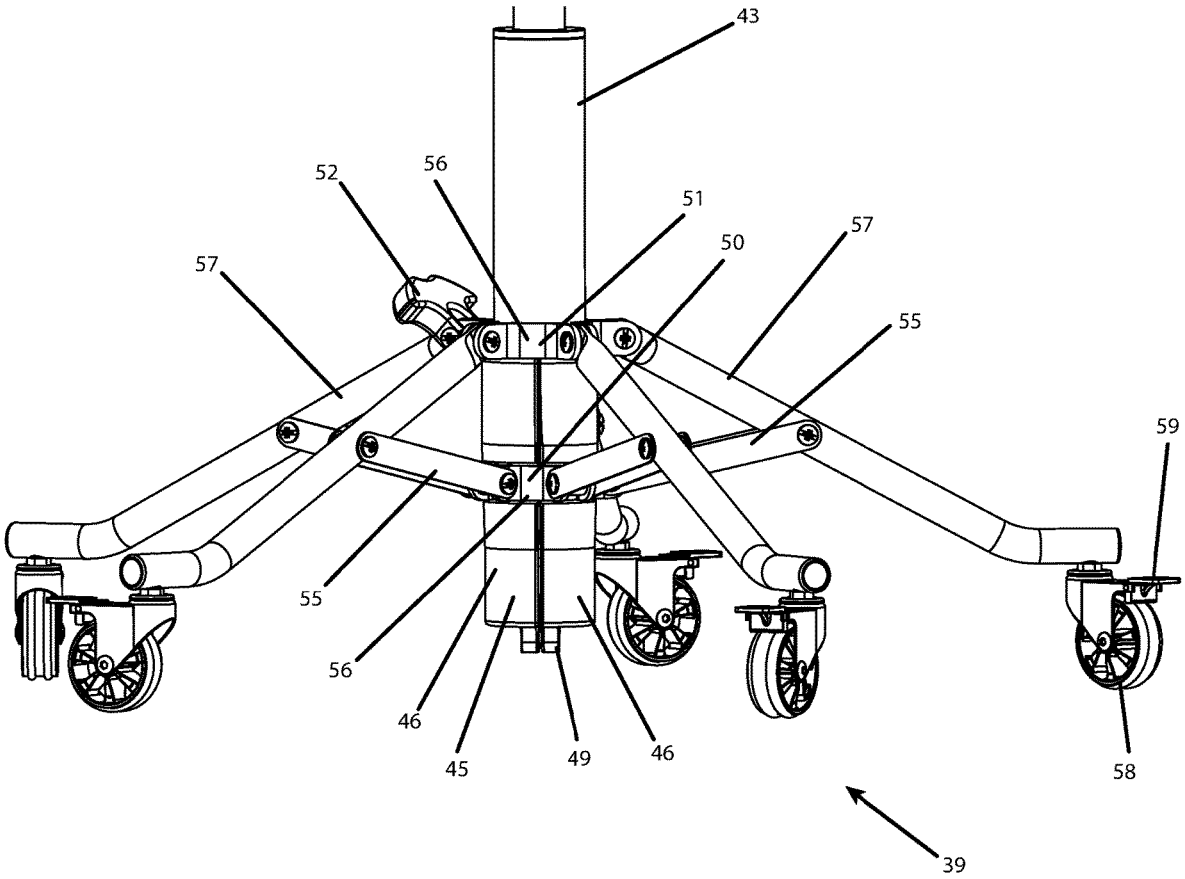
FIGS. 5C and 5D are close-up perspective views of a central support member, including the mated cylindrical collar of FIG. 5B, as well as first and second leg retaining bracket assemblies, and leg members of a collapsible seat.
Figure 5D:
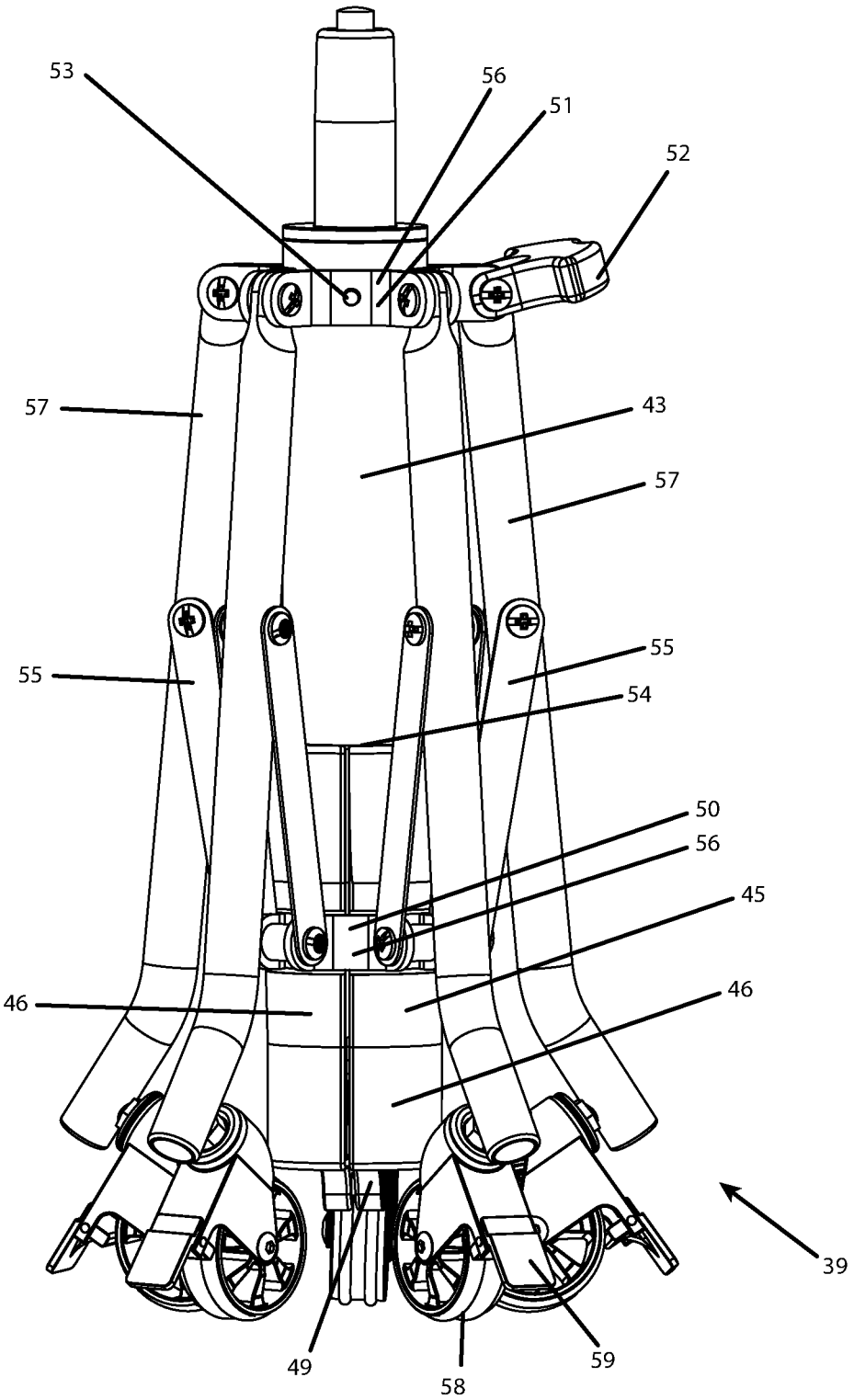

Referring now to FIGS. 5C and 5D, leg/wheel assembly 39 generally includes leg members 57, wheels/casters 58, struts 55, first/lower leg retaining bracket assembly 50, second/upper leg retaining bracket assembly 51, leg raising/lowering handle 52, and leg/lowering raising locking assembly 53.

As may be appreciated from the figures, each of a plurality of leg members 57 is shown as securing a wheel/caster 58 at a first end thereof and pivotally securing a first end of a strut member 55 at a mid-portion thereof, which strut member 55 includes a second end pivotally securable to a U-shaped bracket 56 of first/lower leg retaining bracket assembly 50, which assembly 50 is prevented from sliding movement within recesses 48. A second end of each leg member is pivotally securable to a U-shaped bracket of the second/upper leg retaining bracket assembly 51, which assembly 51 is configured for sliding movement. While the figures illustrate that the leg/wheel assembly 39 comprises a total of five (5) leg members, wheels, etc., it should be appreciated that the collapsible chair can comprise as little as three (3) leg members, wheels, etc. As previously discussed, first/lower leg retaining bracket assembly 50 is secured within recesses 48 such that sliding movement is prevented and second/upper leg retaining bracket assembly 51 is configured for sliding movement along a length of gas piston 43 such that the leg/wheel assembly 39 may be placed in the open/extended position as shown in FIG. 5C and the closed/collapsed position as shown in FIG. 5D. For purposes of readily re-arranging the leg/wheel assembly 39 from the open/extended position of FIG. 5C to the closed/collapsed position of FIG. 5D, and vice-versa, leg raising/lowering handle 52 is provided (See FIGS. 1A-1C). Additionally, for purposes of maintaining the leg/wheel assembly 39 in the open/extended position and the closed/collapsed position, leg raising/lowering locking assembly 53 is provided. Leg raising/lowering locking assembly 53 can comprise a thumbscrew receivable in a threaded through-hole of a U-shaped bracket member 56 of second/upper leg retaining bracket assembly 51 (See, e.g., FIG. 5D) that can be rotated to frictionally secure the thumbscrew against the outer wall of the gas piston 43, or rotated to be secured within appropriately placed recesses of the gas piston corresponding to the open/extended position and the closed/collapsed position. Leg raising/lowering locking assembly 53 may also comprises a biased ball/detent receivable within through-holes or recesses corresponding to the open/extended position and the closed/collapsed position. Each of wheels/casters can include brake 59 for preventing rotational movement of the wheels.

Figure 6A:
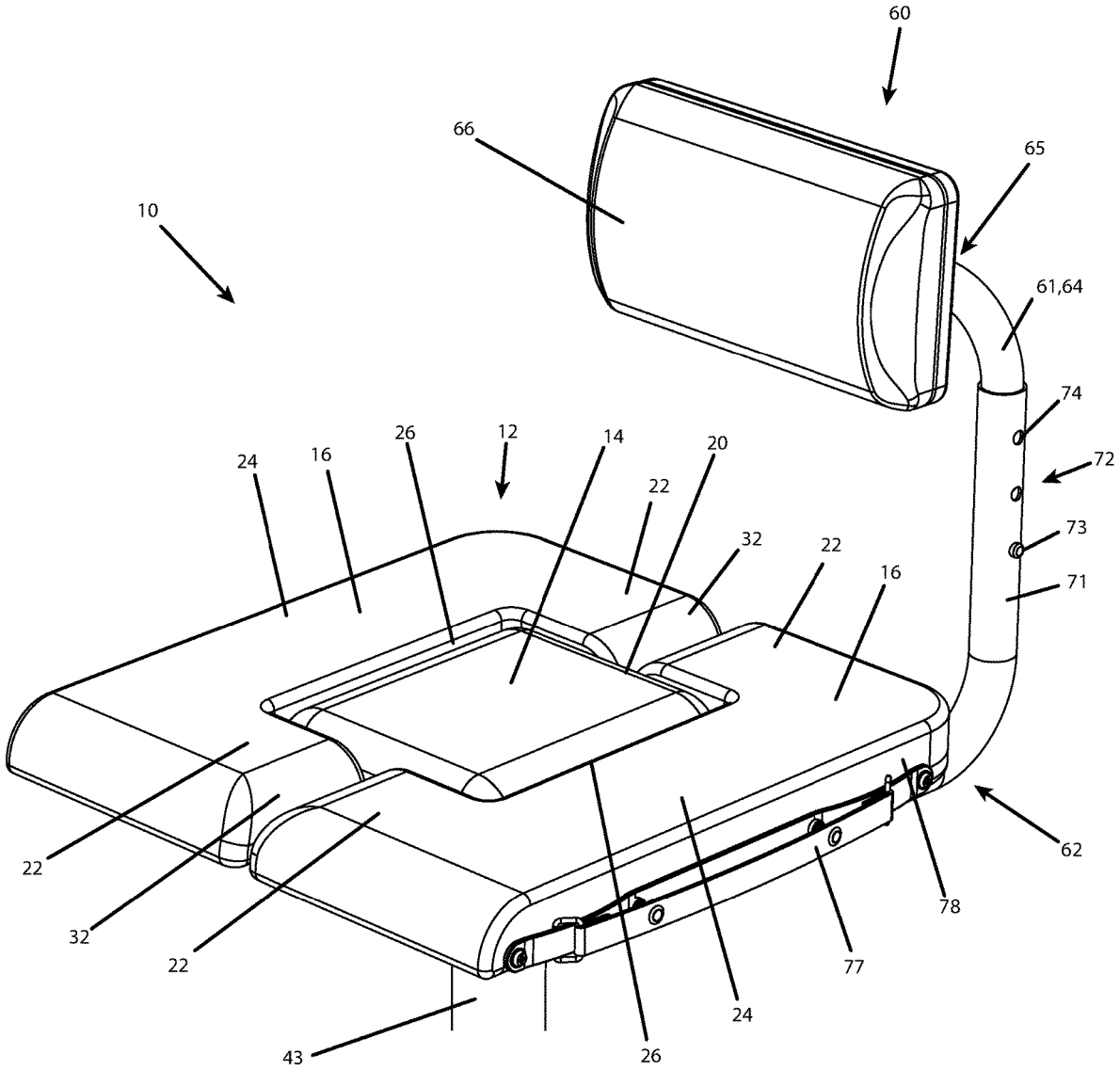
FIGS. 6A and 6B are close-up perspective views of a seating surface member and backrest member illustrating the backrest member in lowered and raised positions, respectively.
Figure 6B:
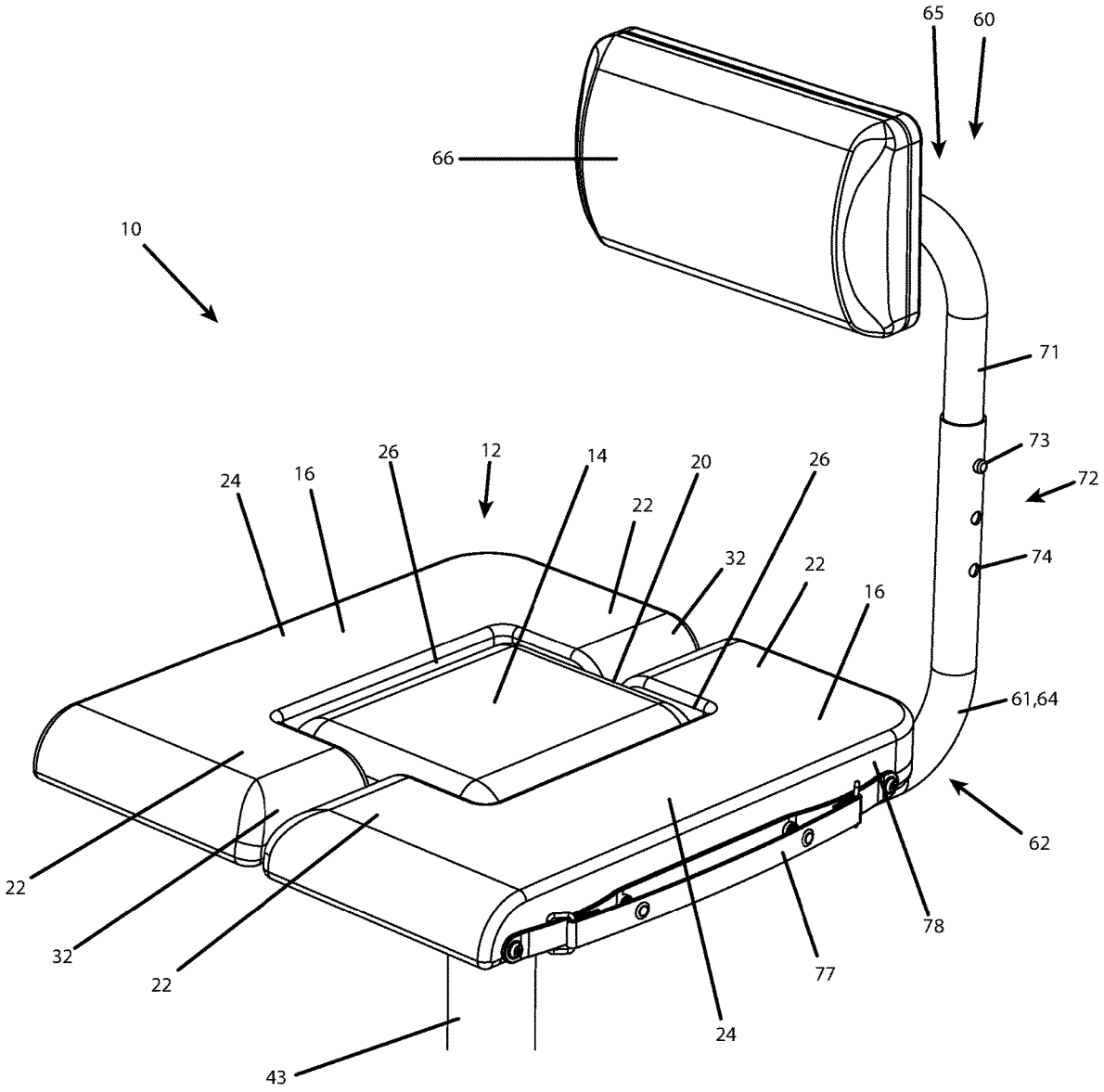
Figure 7A:
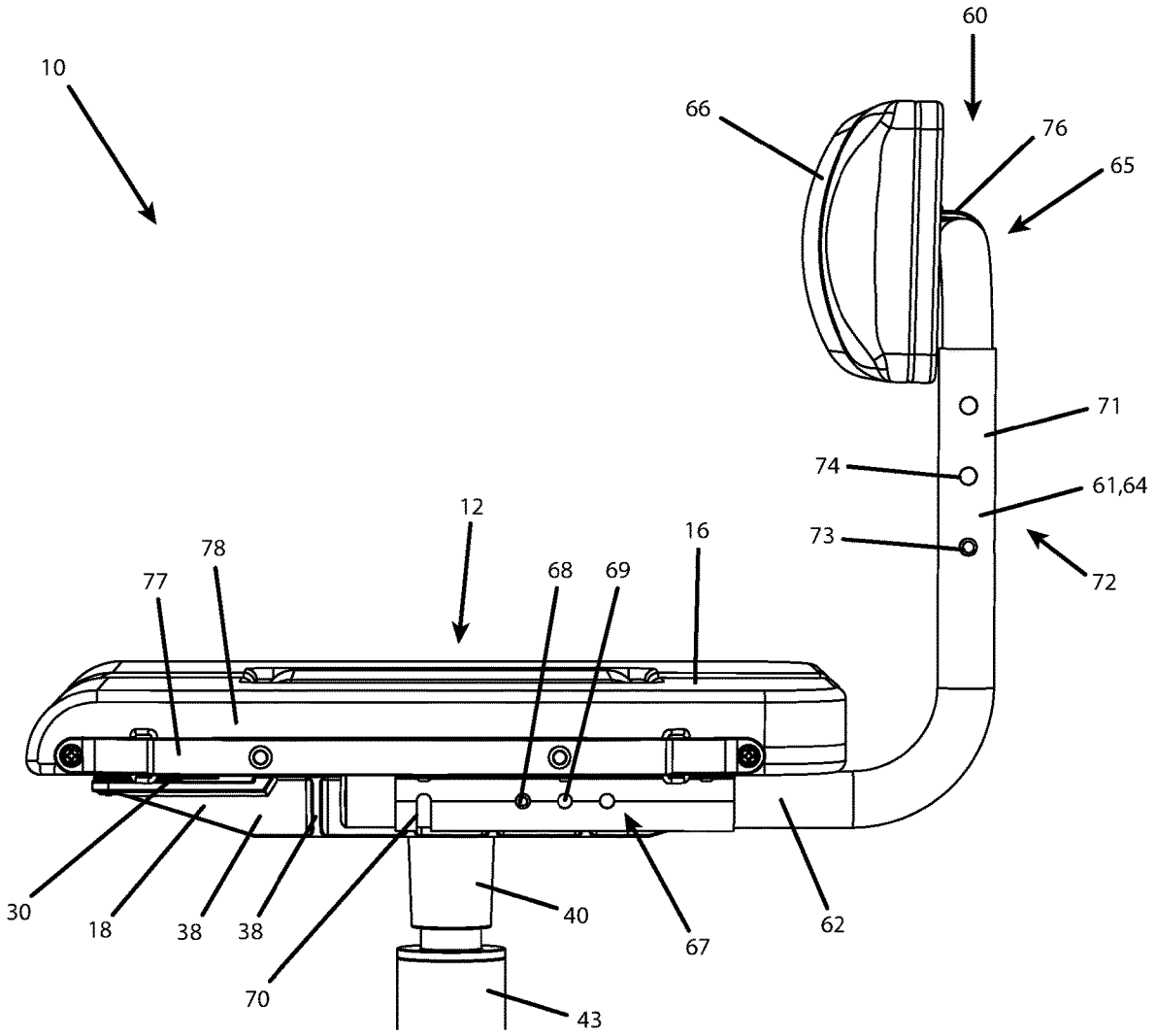
FIGS. 7A-7D are perspective views of a seating surface member and the backrest assembly of a collapsible seat in open/extended positions and closed/collapsed positions; and, FIG. 8 is a rearward perspective view of a seating surface member and backrest of a collapsible seat.
Figure 7B:
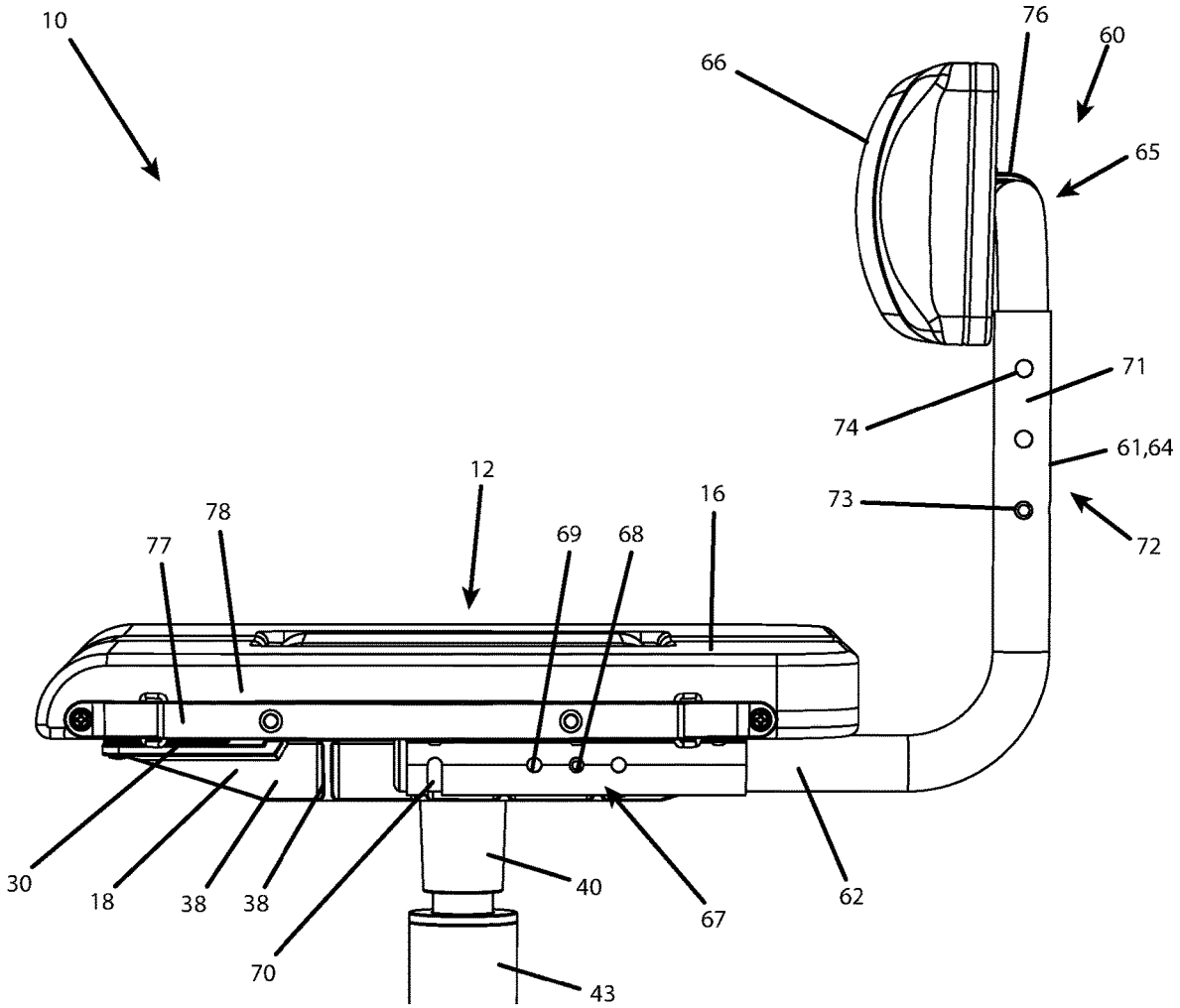
Figure 7C:
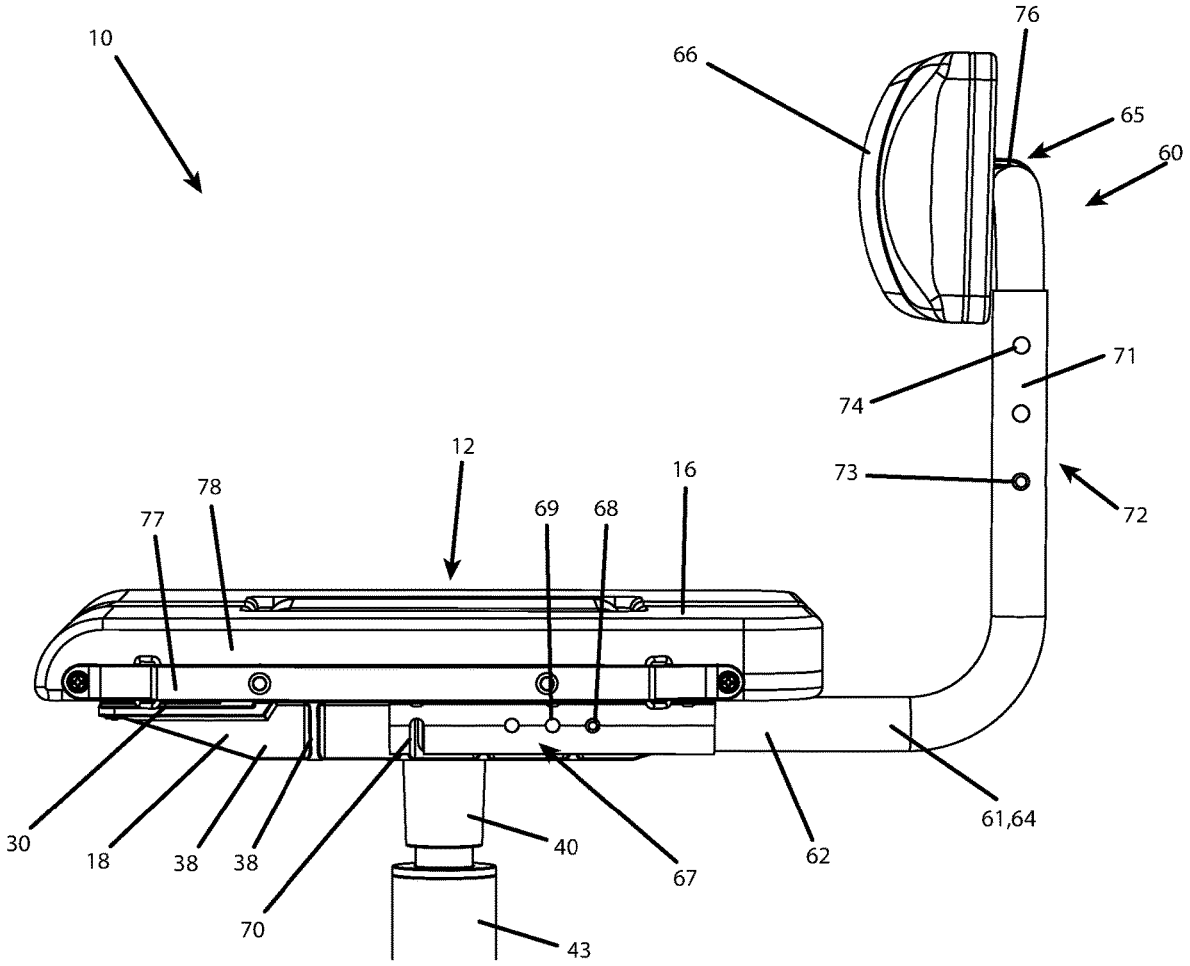
Figure 7D:
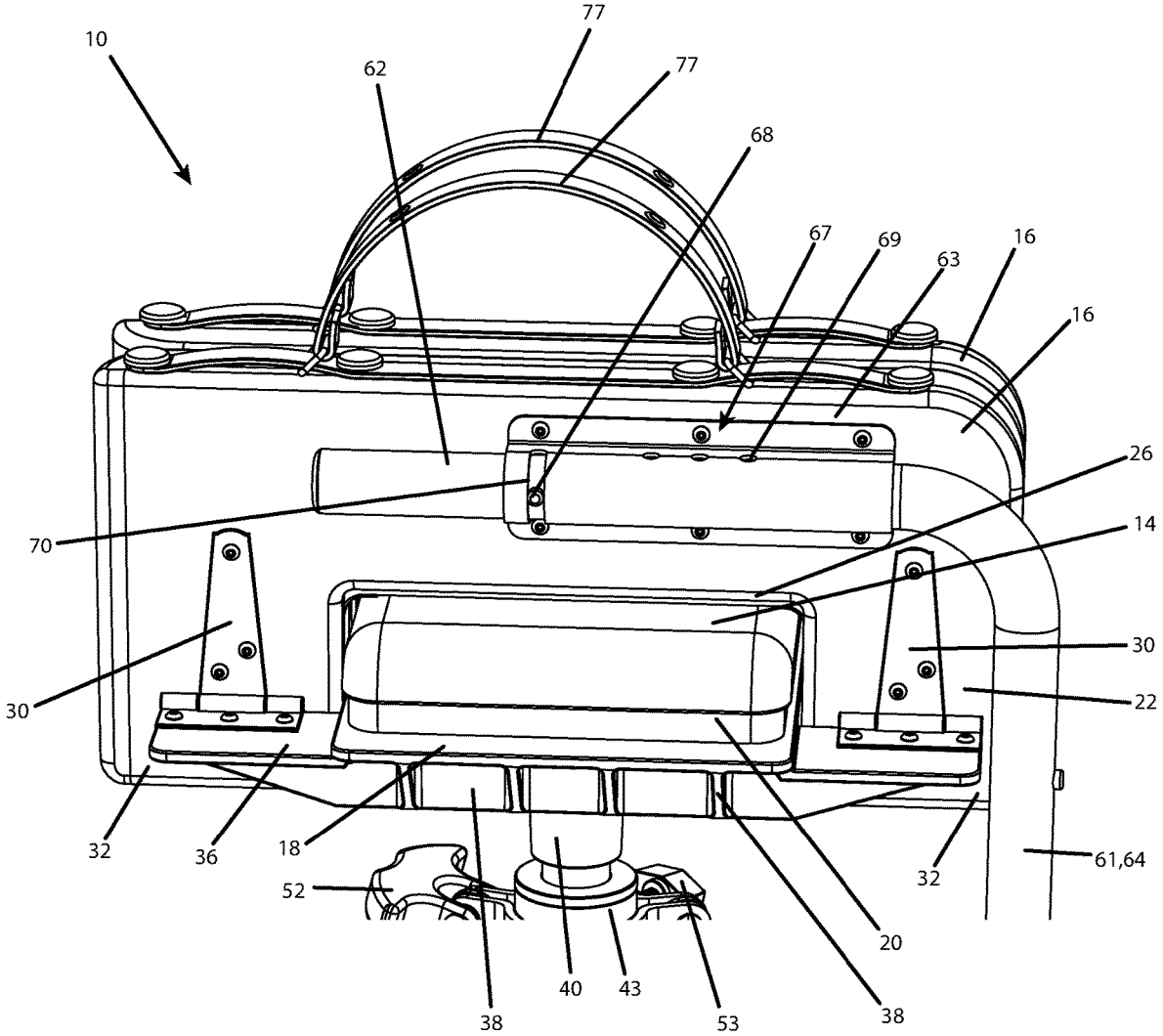
Figure 8:
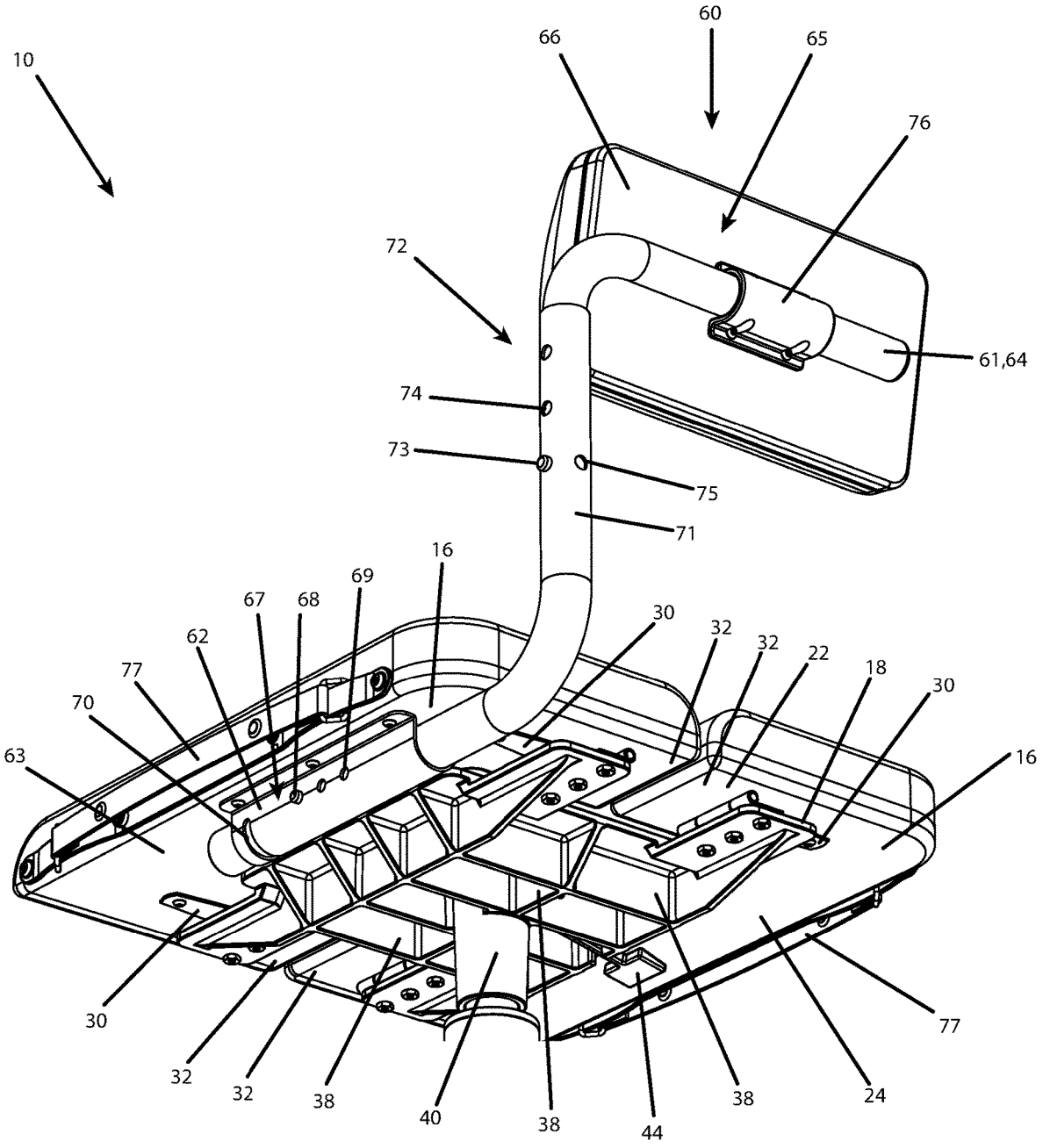

Turning now to FIGS. 6-8, as previously discussed, multi-positional lumbar support assembly 60 is secured to a bottom surface of a generally U-shaped seating surface member 16 and is generally configured for movement between an open/extended position as shown, for example, in FIGS. 6A-7C and a closed/collapsed position as shown in FIG. 7D. Multi-positional lumbar support assembly 60 generally comprises backrest member 66, a plurality of tube members 61/64 receivable and rotatable relative to one another, and a detent bracket assembly 67.

As shown in the figures, tube members 61/64 (and lumbar support assembly 60 in general) generally comprise a first end portion 62 corresponding to that portion rotationally secured to the bottom surface 63, a second end portion 65 corresponding to the backrest member 66 and a mid-portion 71 disposed between the first end portion and the second end portion.

First end portion 62 is generally received and rotatable within detent bracket assembly 67. As shown in FIGS. 7A-7D, detent bracket assembly includes biased ball/pin member 68, linearly incremented through-holes 69 capable of receiving the ball/pin member therein, as well as rotationally offset through-hole/channel 70. As may be appreciated from the incremented positions of the ball/pin member 68 relative to linearly incremented through-holes 69 and through-hole/channel 70 in each of FIGS. 7A-7D, the first end portion 62 of the tube members 61/64 may be incrementally positioned in frontward/rearward directions or rotated and placed in the closed/collapsed position by operation of the biased ball/detent 68.

Mid-portion 71 is generally connected to the first end portion 67 via a u-shaped section tube member and includes detent assembly 72 comprising a plurality of linearly incremented through-holes 74 and rotationally offset through-hole 75, each of which through-holes 74/75 are capable of receiving a biased ball/pin member 73 therein. As may be appreciated from the incremented positions of the ball/pin member 73 relative to linearly incremented through-holes 74 and through-hole 75 in each of FIGS. 7A-7D, the mid-portion of the of the tube members 61/64 may be incrementally positioned in upward/downward directions or rotated and placed in the closed/collapsed position (See FIG. 1C) by operation of the biased ball/detent 73.

As shown in FIG. 8, second end portion 65 is generally connected the mid-portion 72 via a u-shaped section tube member, and includes rotational backrest retaining bracket 76 that receives and frictionally rotationally secures tube member 61/64 such that the backrest member may be pivoted in upward and downward directions, and frictionally retained in a desired positioned, by a user. While not shown, the rotational backrest retaining bracket could comprise a plurality of through-holes capable of receiving a biased ball/pin member therein for incrementally adjusting the upward or downward positions of the backrest member 66.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 Collapsible Seat
12 Seating Surface Assembly
14 Central Seating Surface Member
16 Generally U-Shaped Seating Surface Member
18 Seat Base Member
19 Central Portion
20 Outer Perimeter (Central Seating Surface Member)
21 Leg Portion (Seat Base Member)
22 Leg Portion (U-Shaped Seating Surface Member)
23 Recess/Void
24 Base Portion (U-Shaped Seating Surface Member)
26 Inwardly Directed Perimeter
30 Hinge Assembly
32 Terminal End (Leg portion of U-Shaped Seating Surface Member)
34 Recess/Void
36 Upper Surface/Side (Seat Base Member)
38 Structural Support Rib
39 Leg/Wheel Assembly
40 Centrally Disposed Socket
42 Central Support Assembly
43 Piston Member
44 Height Adjustment Lever
45 Cylindrical Collar
46 Cylindrical Collar Mating Member
47 Tapered Structural Support Rib Structure
48 Collar Mating Member Recess
49 Collar Member Fastening Assembly
50 First/Lower Leg Retaining Bracket Assembly (Fixed)
51 Second/Upper Leg Retaining Bracket Assembly (Slidable)
52 Leg Raising/Lowering Handle
53 Leg Raising/Lowering Locking Assembly
54 Upper Portion of Cylindrical Collar
55 Strut Member
56 U-shaped Bracket Member
57 Leg Member
58 Wheel Caster
59 Wheel/Caster Brake
60 Multi-positional Lumbar Support Assembly
61 Tube Member
62 First End Portion (Seat Base)
63 Bottom Surface
64 Tube Member
65 Second End Portion
66 Backrest Member
67 Detent Bracket Assembly (First End Portion)
68 Ball/Pin Member
69 Linearly Incremented Through-holes
70 Rotationally Offset Through-holes/Channel
71 Mid-portion
72 Detent Assembly (Mid-portion)
73 Ball/Pin Member
74 Linearly Incremented Through-holes
75 Rotationally Offset Through-hole
76 Rotational Backrest Retaining Bracket
77 Carrying Handle
78 Outer Edge
79 Magnet/Magnetically Attractive Member (Handle)
80 Magnetically Attractive Member/Magnet (Seat)

What is claimed is:

1. A collapsible stool or chair comprising:

a seat base member comprising a plurality of intersecting rib members substantially forming a coffered support structure;

a seating surface member collapsible between an open, extended position configured to provide a seating surface, and a collapsed, closed position, the seat surface member including:

a central seating surface member fixed to the seat base member and defining an outer perimeter, and a pair of oppositely disposed and generally u-shaped seating surface members pivotally secured to the seat base member, wherein, each of the generally u-shaped seating surface members include a pair of leg portions extending from a base portion thereof, each of the u-shaped seating surface members having an inward directed perimeter thereof, a portion of each inward directed perimeter having a shape that substantially complementarily corresponds to a shape of a portion of the outer perimeter of the central seating surface member;

wherein, each of the leg portions include a hinge assembly secured proximate terminal ends thereof and to the seat base member such that each oppositely disposed and generally u-shaped seating surface member is pivotal between the open, extended position, and the collapsed, closed position; and, wherein, when pivoted to the open, extended position, the inward directed perimeter of each of the pair of generally u-shaped seating surface members define a recess that substantially complementarily bounds and receives the outer perimeter of the central seating surface member therein;

a central support member including a telescoping piston member configured to adjust a height of the seating surface member; and, at least three leg members, each pivotal between an open, extended position, and a closed, collapsed position.

2. The collapsible stool or chair of claim 1, wherein the outer perimeter of the central seating surface member substantially defines at least one or more of a portion of: a line, an arc, a circle, an oval, and a square, and the inward directed perimeter of each of the pair of generally u-shaped seating surface members has a shape that is substantially complementary therewith.

3. The collapsible stool or chair of claim 1, wherein a pivoting range of movement of the generally u-shaped seating surface members is between 0°, which corresponds to the open, extended position, and 90°, which corresponds to the closed, collapsed position, and wherein the upper side of the seat base member serves as a stop limiting the pivoting movement of the generally u-shaped seating surface members.

4. The collapsible stool or chair of claim 1, wherein the seat base member includes a socket configured to connect the seat base member to the central support member including the telescoping piston member configured to adjust a height of the seating surface member, the central support member including an adjusting lever configured to adjust a height of the seating surface member.

5. The collapsible stool or chair of claim 4, wherein the central support member includes a cylindrical collar having a cylindrical cavity configured to receive and secure the telescoping piston member therein.

6. The collapsible stool or chair of claim 5, wherein the cylindrical collar comprises at least two mating members detachable securable to one another, each of the mating members including at least one tapered structural support rib on an inner surface thereof such that when the at least two mating members are secured to one another for purposes of receiving and securing the telescoping piston member therein, a bias is applied by the tapered ribs to the telescoping piston member such that the piston member is frictionally secured within the cavity.

7. The collapsible stool or chair of claim 5, wherein the cylindrical collar comprises at least two mating members detachable securable to one another, each of the mating members including at least one recess extending about an outer wall thereof, and wherein, when the at least two mating members are secured to one another to form the cylindrical collar, the recesses align with one another to extend about the circumference of the cylindrical collar, and wherein, when a first leg retaining bracket is disposed within the aligned recesses, the first leg retaining bracket is secured therein and prevented from longitudinally directed movement relative to the cylindrical collar.

8. The collapsible stool or chair of claim 7, wherein a second leg retaining bracket is securable about a circumference of the telescoping piston member, the second leg retaining member configured for longitudinally directed sliding movement relative to the telescoping piston member.

9. The collapsible stool or chair of claim 8, wherein the first and second leg retaining members pivotally secure at least three leg members such that the leg members are pivotal between the open, extended position, and the closed, collapsed position.

10. The collapsible stool or chair of claim 9, wherein an upper portion of the cylindrical collar serves as a stop to limit a range of the longitudinal movement of the second leg retaining member such that the leg members may be retained in the open, extended position.

11. The collapsible stool or chair of claim 10, wherein each of the legs include a wheel or caster member.

12. The collapsible stool or chair of claim 1, further comprising a rotationally positionable lumbar support member positionable between an open, extended position and a closed, collapsed position.

13. The collapsible stool or chair of claim 12, wherein the rotationally positionable lumbar support comprises a first end portion rotatably secured to a bottom surface of one of the generally u-shaped seating surface members, and a second end portion that rotatably secures a backrest member.

14. The collapsible stool or chair of claim 13, wherein the first end portion rotatably secured to the bottom surface of one of the generally u-shaped seating surface members includes at least one detent mechanism that arrests the rotationally positionable lumbar support member in the open, extended position and the closed, collapsed position.

15. The collapsible stool or chair of claim 13, wherein the detent mechanism comprises a biased ball or pin member and a plurality of linearly incremented through-holes for receiving the ball or pin member therein to incrementally linearly position the rotationally positionable lumbar support member in a frontward or rearward direction.

16. The collapsible stool or chair of claim 13, wherein the rotationally positionable lumbar support member includes a mid-portion between the first end portion and the second end portion, the mid-portion being rotatable and telescoping to thereby allow the backrest member to be rotated and allow a height of the backrest member to be incrementally adjusted, the mid-portion comprising a biased ball or pin member and a plurality of through-holes for receiving the ball or pin member therein such that the backrest member can be rotationally adjusted and incrementally linearly positioned in an upward direction, or extended position, and a downward direction, or collapsed position.

17. The collapsible stool or chair of claim 13, wherein the backrest member is rotationally positionable and includes a detent mechanism that limits a range of rotation of the backrest member, the detent mechanism including a ball or pin member receivable in a slot or channel.

18. The collapsible stool or chair of claim 1, wherein each of the pair of generally u-shaped seating surface members include a carrying handle member on an outer edge thereof; and, wherein when each generally u-shaped seating surface members is pivoted to the open, extended position, the carrying handle members are oriented such that they correspond to leftward or rightward sides of the collapsible stool or chair; and, wherein, when each generally u-shaped seating surface members is pivoted to the closed, collapsed position, the carrying handle members are oriented toward an upper side of the collapsible stool or chair.

19. The collapsible stool or chair of claim 18, wherein each of the carrying handle members are slidably secured to an outer edge of a respective generally u-shaped seating surface member and each further comprises an embedded magnet that is magnetically attracted to an embedded magnet or a magnetically attractive member disposed proximate a surface of the outer edge of each of the generally u-shaped seating surface members.

20. A collapsible stool or chair comprising:

a seat base member;

a seating surface member collapsible between an open, extended position configured to provide a seating surface, and a collapsed, closed position, the seat surface member including:

a central seating surface member fixed to the seat base member and defining an outer perimeter, and a pair of oppositely disposed and generally u-shaped seating surface members pivotally secured to the seat base member, wherein, each of the generally u-shaped seating surface members include a pair of leg portions extending from a base portion thereof, each of the u-shaped seating surface members having an inward directed perimeter thereof, a portion of each inward directed perimeter having a shape that substantially complementarily corresponds to a shape of a portion of the outer perimeter of the central seating surface member;

wherein, each of the leg portions include a hinge assembly secured proximate terminal ends thereof and to the seat base member such that each oppositely disposed and generally u-shaped seating surface member is pivotal between the open, extended position, and the collapsed, closed position;

wherein, when pivoted to the open, extended position, the inward directed perimeter of each of the pair of generally u-shaped seating surface members define a recess that substantially complementarily bounds and receives the outer perimeter of the central seating surface member therein;

a central support member including a telescoping piston member configured to adjust a height of the seating surface member; and, at least three leg members, each pivotal between an open, extended position, and a closed, collapsed position;

wherein the seat base member includes a socket configured to connect the seat base member to the central support member including the telescoping piston member configured to adjust a height of the seating surface member, the central support member including an adjusting lever configured to adjust a height of the seating surface member;

wherein the central support member includes a cylindrical collar having a cylindrical cavity configured to receive and secure the telescoping piston member therein; and, wherein the cylindrical collar comprises at least two mating members detachable securable to one another, each of the mating members including at least one tapered structural support rib on an inner surface thereof such that when the at least two mating members are secured to one another for purposes of receiving and securing the telescoping piston member therein, a bias is applied by the tapered ribs to the telescoping piston member such that the piston member is frictionally secured within the cavity.

* * * * *